US007658372B2

(12) United States Patent
Kubo

(10) Patent No.: US 7,658,372 B2
(45) Date of Patent: Feb. 9, 2010

(54) SHEET PROCESSING APPARATUS AND IMAGE FORMING APPARATUS

(75) Inventor: Masayoshi Kubo, Kashiwa (JP)

(73) Assignee: Canon Finetech Inc., Misato-Shi (JP)

( * ) Notice: Subject to any disclaimer, the term of this patent is extended or adjusted under 35 U.S.C. 154(b) by 294 days.

(21) Appl. No.: 11/470,445

(22) Filed: Sep. 6, 2006

(65) Prior Publication Data

US 2007/0052148 A1 Mar. 8, 2007

(30) Foreign Application Priority Data

Sep. 8, 2005 (JP) ..... 2005-261369
Sep. 8, 2005 (JP) ..... 2005-261370

(51) Int. Cl.
*B65H 37/04* (2006.01)

(52) U.S. Cl. ..... 270/37; 270/32; 270/45; 270/51; 270/58.07; 270/58.08; 270/58.09; 270/58.11; 270/58.12; 270/58.17; 270/58.27

(58) Field of Classification Search ..... 270/32, 270/37, 45, 51, 58.07, 58.08, 58.09, 58.11, 270/58.12, 58.17, 58.27
See application file for complete search history.

(56) References Cited

U.S. PATENT DOCUMENTS 5,382,011 A 1/1995 Tani ..... 270/37
5,442,432 A 8/1995 Tani ..... 355/324
6,022,011 A * 2/2000 Hirose ..... 270/37
6,671,491 B1 12/2003 Yamanaka et al. ..... 399/407
6,799,759 B1 * 10/2004 McNamara et al. ..... 270/58.08
7,192,020 B2 3/2007 Hayashi et al. ..... 270/58.11
7,413,176 B2 * 8/2008 Hirata et al. ..... 270/58.08
2005/0104269 A1 * 5/2005 Kamiya et al. ..... 270/32
2005/0121848 A1 * 6/2005 Kodama et al. ..... 270/58.12
2006/0017209 A1 * 1/2006 Kushida et al. ..... 270/37
2007/0102860 A1 5/2007 Hayashi et al. ..... 270/58.11

FOREIGN PATENT DOCUMENTS

JP 6-72064 3/1994
JP 10-279163 10/1998
JP 2001-72310 3/2001
JP 2001-72311 3/2001
JP 2003-241578 8/2003

* cited by examiner

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

A sheet processing apparatus including: a stapler; a conveying path, which conveys a sheet to the stapler; a bundle forming device to form a sheet bundle in the conveying path, the bundle forming device having a pinch device, which successively pinches an upstream end portion of the sheet to pinch plural sheets integrally; a control portion, which controls the stapler and the bundle forming device to staple the sheet bundle selectively between at one end of the sheet bundle for the side stitching and on the fold line of the sheet bundle for the saddle stitching; a discharging device, which discharges the sheet bundle stapled at the one end onto a stacking portion, a two-fold device, which folds the sheet bundle stapled on the fold line in two along the fold line, and a joining device, which joins the sheet bundle folded by the two-fold device into the discharging device.

10 Claims, 13 Drawing Sheets

SHEET PROCESSING APPARATUS AND IMAGE FORMING APPARATUS

BACKGROUND OF THE INVENTION

1. Field of the Invention

The invention relates to a sheet processing apparatus, which can receive, sheets discharged from an image forming apparatus such as a copying machine, a printer, a facsimile apparatus or a compound machine, or a business machine, and can carry out a so-called bookbinding process.

Also, the invention relates to an image forming apparatus such as a copying machine, a printer, a facsimile apparatus or a compound machine, and particularly to an image forming apparatus capable of incorporating thereinto a sheet processing function such as the bookbinding process of forming a sheet bundle and saddle-stitching the sheet bundle, and thereafter folding the sheet bundle in two, compactly and in light weight and in a custom-made fashion.

2. Description of the Related Art

There has been put into practical use a sheet processing apparatus which can carry out a so-called binding process of receiving sheets discharged from an image forming apparatus such as a copying machine, a printer or a facsimile apparatus one by one and forming a sheet bundle, and stapling (saddle-stitching) the formed sheet bundle on its fold line, and folding (bundle-folding) the stapled sheet bundle in two on its fold line into a brochure, and outputting and stacking the brochure.

It is often the case that this sheet processing apparatus capable of carrying out the bookbinding process is arranged on the downstream side of an image forming apparatus main body for forming an image on a sheet. In some types of the image forming apparatus, the sheet processing apparatus capable of carrying out the bookbinding process is integrally contained or connected as a purchase option (so-called option).

Also, many of sheet processing apparatuses capable of carrying out the bookbinding process can select and execute one of several processing menu such as the so-called end binding process of stapling one end of a formed sheet bundle, the simple stacking process of simply stacking sheets one by one without forming a sheet bundle, and the punching process of forming holes for filing in a sheet or a sheet bundle.

Japanese Patent Application Laid-open No. H6-72064 discloses a recording apparatus, which can selectively effect side stitching and saddle stitching by a single stapler. The recording apparatus can stack sheet bundle at a common position, and effect the flat binding at the common position, and effect the saddle stitching by moving a sheet bundle by a predetermined amount from the common position.

In a sheet processing apparatus shown in Japanese Patent Application Laid-open No. H10-279163. An exclusive processing unit for carrying out the bookbinding process is disposed below a universal processing unit capable of carrying out the end binding process and the simple stacking process, and one of these processes can be selected and executed.

In a sheet processing apparatus shown in Japanese Patent Application Laid-open No. 2001-72310, a two-fold mechanism for folding a sheet bundle in two is disposed on the inner part side of a processing tray for receiving sheets one by one and forming a sheet bundle, and the saddle stitching process in the bookbinding process is carried out by the use of a stapling device for carrying out the end binding process.

A sheet processing apparatus shown in Japanese Patent Application Laid-open No. 2003-241578 has a discharging path for conveying a two-fold sheet bundle to a position at which it flatly overlaps simply stacked sheets, and a sheet bundle subjected to the bookbinding process is stacked on a fixed exclusive stack tray through this discharging path.

In an image forming apparatus shown in Japanese Patent Application Laid-open No. 2001-72311, below an image reading apparatus (scanner apparatus), there are disposed an image forming portion contained in the plane of the image reading apparatus and using a photosensitive drum, a processing tray for forming a sheet bundle, and a vertically movable stack tray, and the trailing edge side of a sheet bundle formed by sheets being stacked on the processing tray is stapled, thereafter the sheet bundle is discharged from the processing tray onto the stack tray and stacked on the latter.

Of course, there has also been put into practical use an image forming apparatus in which below an apparatus main body of a common specification for forming an image on a sheet, various sheet cassette units formed into the same planar outline and side appearance as the apparatus main body are connected together, whereby the processing capability in a wide sense is made changeable.

In recent years, in order to save the installation space of an image forming apparatus including a sheet processing apparatus, and increase the degree of freedom of the layout of the interior of a room around the installation space, the downsizing of the image forming apparatus including the sheet processing apparatus has been desired, and as shown in Japanese Patent Application Laid-open No. 2001-72311, there has been commercialized an image forming apparatus in which the number of possible sheet processes is reduced to thereby make the in-body discharge of a sheet bundle possible.

However, in the image forming apparatus wherein the in-body discharge is effected, the full height of the apparatus is suppressed and yet, a stacking space for sheets and sheet bundles is secured in the plane of the apparatus and therefore, the disposition space for a mechanism in the sheet processing apparatus is limited, and it is impossible to additionally dispose an exclusive processing unit for carrying out such a bookbinding process as shown in Japanese Patent Application Laid-open No. 2001-72310.

Yet, it greatly spoils the commercial value of the image forming apparatus to provide only the exclusive processing unit for carrying out the bookbinding process, which is merely a convenient additional function to an ordinary user, and eliminate the requisite end binding process unit.

So, as shown in Japanese Patent Application Laid-open No. 2001-72310, there has been proposed to carry out the saddle stitching process in the bookbinding process by the use of a stapling apparatus for carrying out the end binding process of a sheet bundle, and in this case, the number of the stapling apparatuses is saved, but a space for move a large sheet before folded in two greatly in a horizontal direction becomes necessary in the machine body and therefore, the length and installation area of the sheet processing apparatus become still greater than those of the sheet processing apparatus shown in Japanese Patent Application Laid-open No. H10-279163.

Also, two-fold sheet bundles are stacked on a stacking place discrete from a vertically movable type stacking tray on which end bound sheet bundles are stacked and therefore, if the stack tray is carried on a sheet processing apparatus which effects the in-body discharge, the full height of the sheet processing apparatus cannot be suppressed, and if two stacking places are forcibly secured, each stacking place becomes narrow and the full load condition occurs earlier and thus, the taking-out of the sheet bundle is effected frequently.

Also, with the above-described sheet cassette as the reference, it has been proposed that below an apparatus main body of a common specification, various sheet processing apparatuses formed into the same plane outline as the apparatus main body be superposed and connected, but when the stacking space for each kind (size) of discharged sheets and sheet bundle is heaped, the full height becomes great, and in the first place, it is not easy to optimize the form and disposition of the stacking space for sheet bundles, for example, a method of taking out the sheet bundle.

In recent years, however, in accordance with an improvement in the color print accuracy of image forming apparatuses, there have been increasing opportunities for preparing presentation materials, and preparing materials in a brochure shape including photographs, and if the bookbinding process can be incorporated into an ordinary sheet processing apparatus capable of carrying out the end binding process, the commercial values of the sheet processing apparatus and the image forming apparatus will greatly heighten and further, if the number of parts thereof can be suppressed to thereby construct the apparatuses compactly and in light weight and at low prices, a great demand for the image forming apparatus can be aroused.

SUMMARY OF THE INVENTION

It is an object of the present invention to provide a sheet processing apparatus for carrying out the end binding process in which members and mechanisms are made functionally more versatile to thereby make the bookbinding process possible, and which is compact in size and light in weight and rich in universality as well as low in price.

It is another object of the present invention to provide a compact sheet processing apparatus in which sheet bundles subjected to the bookbinding process are discharged into and highly efficiently stacked in a stacking space for end bound sheet bundles, whereby a stacking space provided with a practical stacking capacity is secured in the body of the sheet processing apparatus (in the plane of an image forming apparatus and yet, of which the full height and installation area are suppressed.

It is also an object of the present invention to provide a sheets processing apparatus including: a stapler; a conveying path along which a sheet is conveyed to the stapler; a bundle forming device disposed in the conveying path for superposing the received sheets one upon another and forming a sheet bundle, the bundle forming device having a pinch device for successively pinching the upstream end portions of the sheets one by one and integrally pinching a plurality of sheets; a control portion, which controls the stapler and the bundle forming device to thereby selectively staple the sheet bundle by the stapler at one end of the sheet bundle in the conveying direction thereof for the side stitching of the sheet bundle, and on the fold line of the sheet bundle for the saddle-stitching of the sheet bundle; a discharging device, which discharges the sheet bundle stapled at the aforementioned one end; a stacking portion on which the sheet bundle discharged by the discharging device is stacked; a two-fold device, which folds the sheet bundle stapled on the aforementioned fold line in two along the aforementioned fold line; and a joining device, which joins the sheet bundle folded by the two-fold device into the discharging device.

It is a further object of the present invention to provide a sheet processing apparatus including: a stapler; a conveying path along which a sheet is conveyed to the stapler; a pinch device disposed in the conveying path for successively pinching the upstream end portions of the received sheets one by one and integrally pinching a plurality of sheets; and a control portion, which repeats the operation of opening the pinch device after the trailing edges of the sheets have passed the pinch device, and closing the pinch device after the sheets have been drawn back to an upstream side, to thereby form a sheet bundle.

It is still a further object of the present invention to provide a sheet processing apparatus including: a stapler; a conveying path along which a sheet is conveyed to the stapler; a bundle forming device disposed in the conveying path for superposing the received sheets one upon another to thereby form a sheet bundle; a branch-off path, which branches off at the upstream position of the stapler from the conveying path toward the upstream side of the conveying path; a control portion, which controls the stapler and the bundle forming device to thereby selectively staple the sheet bundle by the stapler at one end of the sheet bundle in the conveying direction of the sheet bundle for the side stitching of the sheet bundle, and on the fold line of the sheet bundle for the saddle-stitching of the sheet bundle; and a two-fold device, which folds the sheet bundle stapled on the aforementioned fold line in two along the aforementioned fold line, the two-fold device being disposed in the branch-off path, wherein the control portion conveys the sheet bundle stapled on the aforementioned fold line to the downstream position of the conveying path, and thereafter reversely conveys the sheet bundle to thereby direct the sheet bundle to the branch-off path.

It is still another object of the present invention to provide an image forming apparatus comprising a combination of an apparatus main body of a standard specification for effecting image formation and a sheet processing apparatus incorporating a necessary sheet processing mechanism therein and of which the full height and the occupied installation area are both decreased and which is compact and light in weight as well as low in price.

It is yet still another object of the present invention to provide an image forming apparatus of an in-body discharge type in which a sheet bundle subjected to an end binding process and a sheet bundle subjected to a bookbinding process are discharged into and highly efficiently stacked in one and the same stacking space, whereby of which the full height and the occupied installation area are reduced and yet, is which provided with a practical stacking capacity.

It is yet still a further object of the present invention to provide a sheet processing apparatus of which the member and mechanism capable of carrying out an end binding process are made functionally more versatile to thereby make a bookbinding process possible, and which is compact and light in weight as well as rich in universality and low in price.

It is also an object of the present invention to provide an image forming apparatus including: an image forming device, which forms images on sheets; and a sheet processing apparatus, which receives the sheets on which the images have been formed by the image forming device and processes the sheets, wherein the sheet processing apparatus has a housing structure constituting the outline thereof, the housing structure is contained in the plane of the image forming device, the housing structure and the image forming device are disposed in superposed relationship with each other, the sheet processing apparatus has a stacking space contained in a plane, the sheets processed by the sheet processing apparatus are stacked in the stacking space, and the sheet processing apparatus is designed to enable the sheets stacked in the stacking space to be taken out from the front side of the image forming apparatus.

It is a further object of the present invention to provide a sheet processing apparatus including: a housing structure constituting the outline of the sheet processing apparatus, the plane outline of the housing structure according to the plane outline of an image forming device, the sheet processing apparatus and the image forming device being capable of being disposed in vertically superposed relationship with each other, a stacking portion disposed inside the housing structure aside toward one of the left and right sides as viewed from the front side of the sheet processing apparatus, and enabling stacked sheets to be taken out from the aforementioned front side, a conveying path, which guides the sheets received from the opposite side of the stacking portion in the plane outline of the housing structure in a horizontal direction and directing them to the stacking portion, a bundle forming device disposed on the entrance side of the conveying path for superposing the sheets received from the image forming device one upon another to thereby form a sheet bundle, and a discharging device disposed on the exit side of the conveying path for discharging the sheet bundle formed by the bundle forming device to the stacking portion.

Further features of the present invention will become apparent from the following description of exemplary embodiments read with reference to the accompanying drawings.

DESCRIPTION OF THE EMBODIMENTS

A sheet processing apparatus 400, which is an embodiment of the present invention and a copying machine 500, which is a form of an image forming apparatus provided with the sheet processing apparatus 400, will hereinafter be described with reference to the accompanying drawings. The image forming apparatus of the present invention is not restricted to the copying machine 500 according to the present embodiment, but the present invention may be carried out by a facsimile apparatus, a printer or a compound machine of these or the like.

Also, the sheet processing apparatus 400 according to the present embodiment is connectable not only in an image forming apparatus of an electrostatic printing type like the apparatus main body 500A of the copying machine 500, but also in other image forming apparatus such as, for example, an image forming apparatus using ink, an image forming apparatus of an ink jet type or a printing apparatus, and the type of image formation does not matter.

Also, the sheet processing apparatus 400 according to the present embodiment may further be carried out as a saddle-stitching machine into which sheets are manually inserted one by one, even if it is constituted by a discrete housing detachably mountable on the apparatus main body 500A, or even if it is unseparably incorporated in the housing of the apparatus main body 500A, or even if the sheet processing apparatus 400 is covered with a single frame member and combined with an automatic sheet feeding apparatus or the like to thereby make an automatic saddle-stitching machine.

Also, in the present embodiment, a control portion 600, which controls the apparatus main body 500A effects the control of each portion concerned in the processing of sheets, but a discrete microcomputer control device or the like independent of the control portion 600 may be provided in the sheet processing apparatus 400 to thereby control the processing of the sheets while effecting bilateral communication with the control portion 600.

In the following description, the upstream side edge of the sheet with respect to a sheet conveying direction is defined as the trailing edge, the downstream side edge thereof is defined as the leading edge, and the edges of the sheet along the conveying direction thereof are defined side edges, a direction crossing the sheet conveying direction is defined as the width of the sheet, it is defined as trailing edge alignment to align the trailing edge of the sheet, and it is defined as side edge alignment to align the side edges.

<Image Forming Apparatus>

Figure 1:
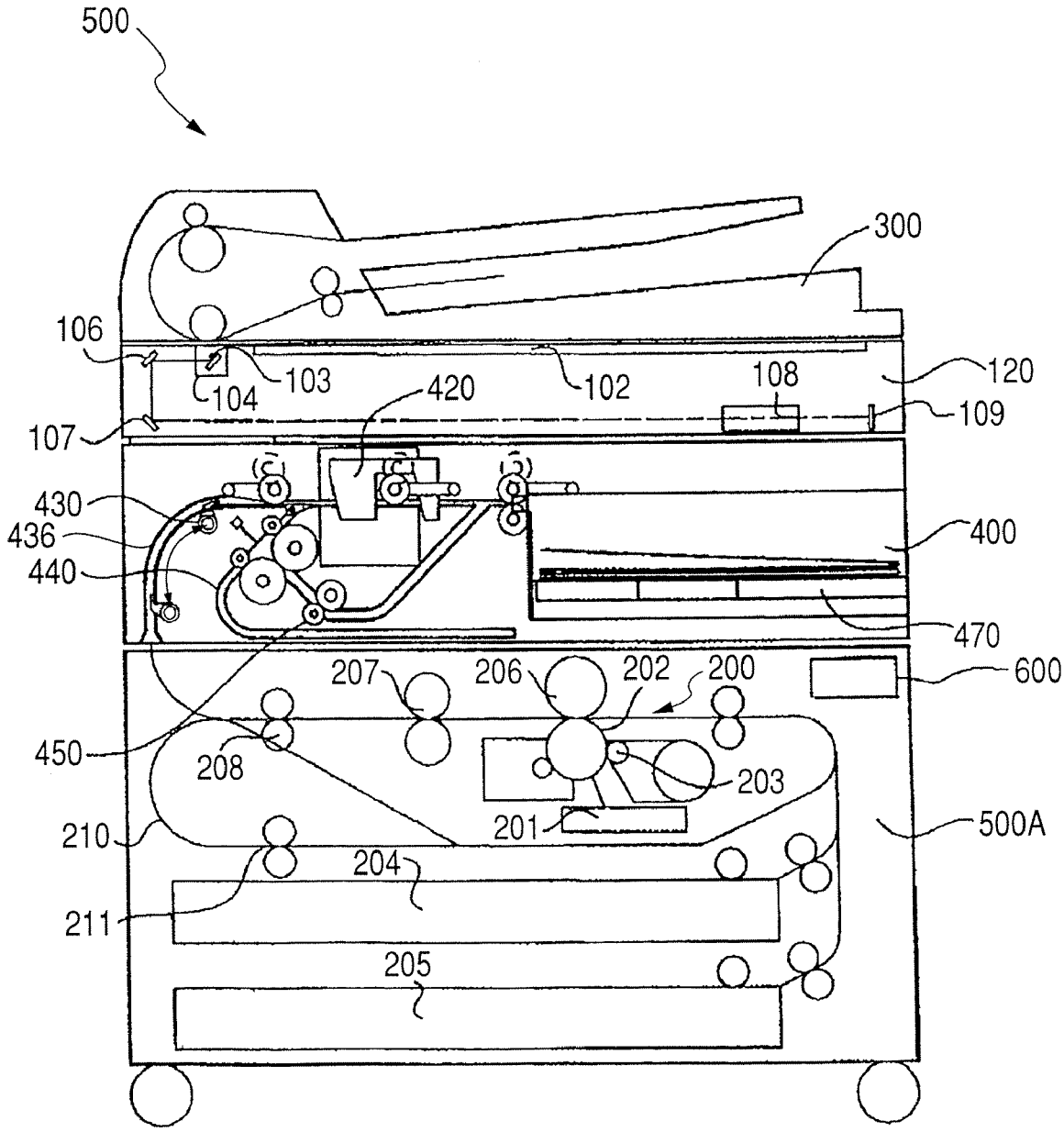
FIG. 1 is a front view of a copying machine provided with a sheet processing apparatus, which is an embodiment of the present invention.

FIG. 1 is a front view of a copying machine provided with a sheet processing apparatus, which is an embodiment of the present invention. For example, the copying machine 500 which is the image forming apparatus of the present invention is provided with, for example, the apparatus main body 500A which is an image forming device, and for example, the sheet processing apparatus 400 which is processing means.

As shown in FIG. 1, the copying machine 500 has a printer portion 200, which forms an image arranged in the apparatus main body 500, and has the sheet processing apparatus 400 capable of carrying out the end binding process and book-binding process of sheets on which images have been formed disposed between a reader portion 120, which reads the image of an original and the apparatus main body 500A. In the upper portion of the apparatus main body 500A, an automatic original feeding apparatus 300 (hereinafter referred to as the "ADF") for supplying originals one by one onto platen glass 102 is mounted so as to be openable and closable to a rearward side.

The copying machine 500 functions as a copying machine, which copies the image of the original read by the reader portion 120 onto the sheet, by a printer portion 200, and in addition, functions as a printer, which receives image data sent from an external personal computer or the like by the printer portion 200, and prints an image on the sheet. Further, the copying machine 500 functions also as a facsimile apparatus, which transmits the facsimile signal of the image of the original read by the reader portion 12 to another facsimile apparatus, and receives a facsimile signal from another facsimile apparatus and prints the image by the printer portion 200.

When a plurality of originals are to be copied, the originals are stacked on the ADF 300 and are successively conveyed one by one to the reader portion 120, and are passed above a stopped scanner unit 104 to thereby effect so-called flow reading. Also, when an original which cannot be handled by the ADF 300 is to be copied, the ADF 300 is opened to the rearward side and the original is placed on the platen glass 102, and the scanner unit 104 is moved in a horizontal direction as viewed in FIG. 1 to thereby effect so-called scan reading.

In any case, the image of a band-shaped area illuminated by the light source of the scanner unit 104 is imaged on a CCD image sensor portion 109 via mirrors 106, 107 and an optical system 108, and a linear image is read by the CCD image sensor portion 109 and is converted into an image signal, and digital processing such as making it into image data and image processing is effected.

The image data subjected to the digital processing is transmitted to the exposure control portion 201 of the printer portion 200 and is evolved and modulated thereby, and is converted into the optical signal of a laser beam. The exposure control portion 201 scans the optical signal of the laser beam and applies it to a photosensitive drum 202, and an electrostatic latent image is formed on the surface of the photosensitive drum 202 by this applied light, and a toner is caused to adhere to the latent image by a developing device 203 to thereby develop the latent image, whereby a toner image is formed on the photosensitive drum 202.

In timed relationship with the leading edge of the toner image, a sheet is conveyed from a sheet cassette 204 or 205, and the toner image is transferred to the sheet in a transferring portion 206. The toner image transferred to the sheet is subjected to a high temperature and pressurization by a fixing portion 207 and is fixed on the sheet. In the case of one-side printing, the sheet on which the fixing has been completed is delivered to the sheet processing apparatus 400 through a sheet discharging portion 208.

In the case of two-side printing, however, the sheet on one side of which the fixing has been completed is fed from the sheet discharging portion 208 into a reversal path 210, and is conveyed in a switchback fashion and is again fed into the transferring portion 206 with its front and rear side reversed. Then, the sheet having had a toner image transferred also to the rear side has the toner image fixed by the fixing portion 207, and thereafter is delivered to the sheet processing apparatus 400 through the sheet discharging portion 208.

The sheet processing apparatus 400 is disposed without protruding from the plane of the apparatus main body 500A including a stacking portion 470 for a sheet bundle.

That is, the sheet processing apparatus 400 is superposed and is integrally connected by fixing screws (not shown) with the apparatus main body 500A including the stacking portion 470 for the sheet bundle and a plane outline made coincident with each other and as if the sheet processing apparatus constituted an integral housing structure together with the apparatus main body 500A and the reader portion 120.

The sheet processing apparatus 400 can select and execute one of three processes, i.e., a simple stacking process of discharging the sheets on which images have been formed one by one to the stacking portion 470 and stacking them thereon, an end binding process of superposing the sheets on which images have been formed one upon another to thereby form a sheet bundle and staple one end thereof, and a bookbinding process of saddle-stitching the center of the formed sheet bundle, and thereafter folding the sheet bundle in two.

In a case where any one process has been selected, the sheets and the sheet bundle are stacked on a common stacking portion 470, and even a sheet bundle formed by bookbinding sheets of a maximum size (A3) which can be handled can be stacked on the stacking portion 470 without protruding from the plane outline of the apparatus main body 500A.

The stacking portion 470 is a space which is opened in two directions, i.e., the front side and the right side thereof, and the sheet bundle stacked on the stacking portion 470 has its situation observable from the front side thereof, and can be taken out by inserting a hand from the front side. However, when sheets of the maximum size (A3) are to be intactly stacked without being folded, they cannot be completely contained in the stacking portion 470 and therefore, it is possible to insert an enlarged tray of substantially A4 size into the right side of the stacking portion 470.

<Sheet Processing Apparatus>

Figure 2:
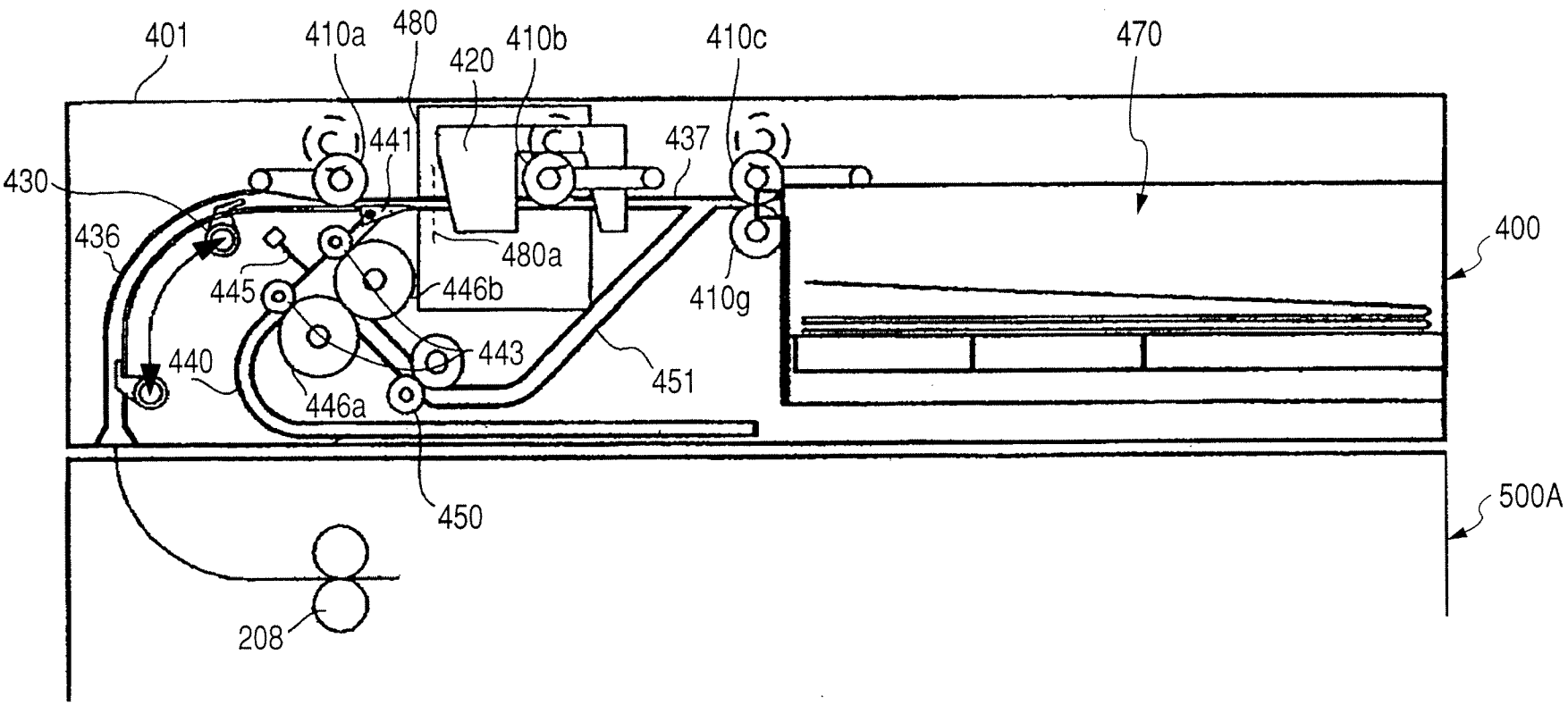
FIG. 2 is an illustration of the construction of the sheet processing apparatus.
Figure 3:
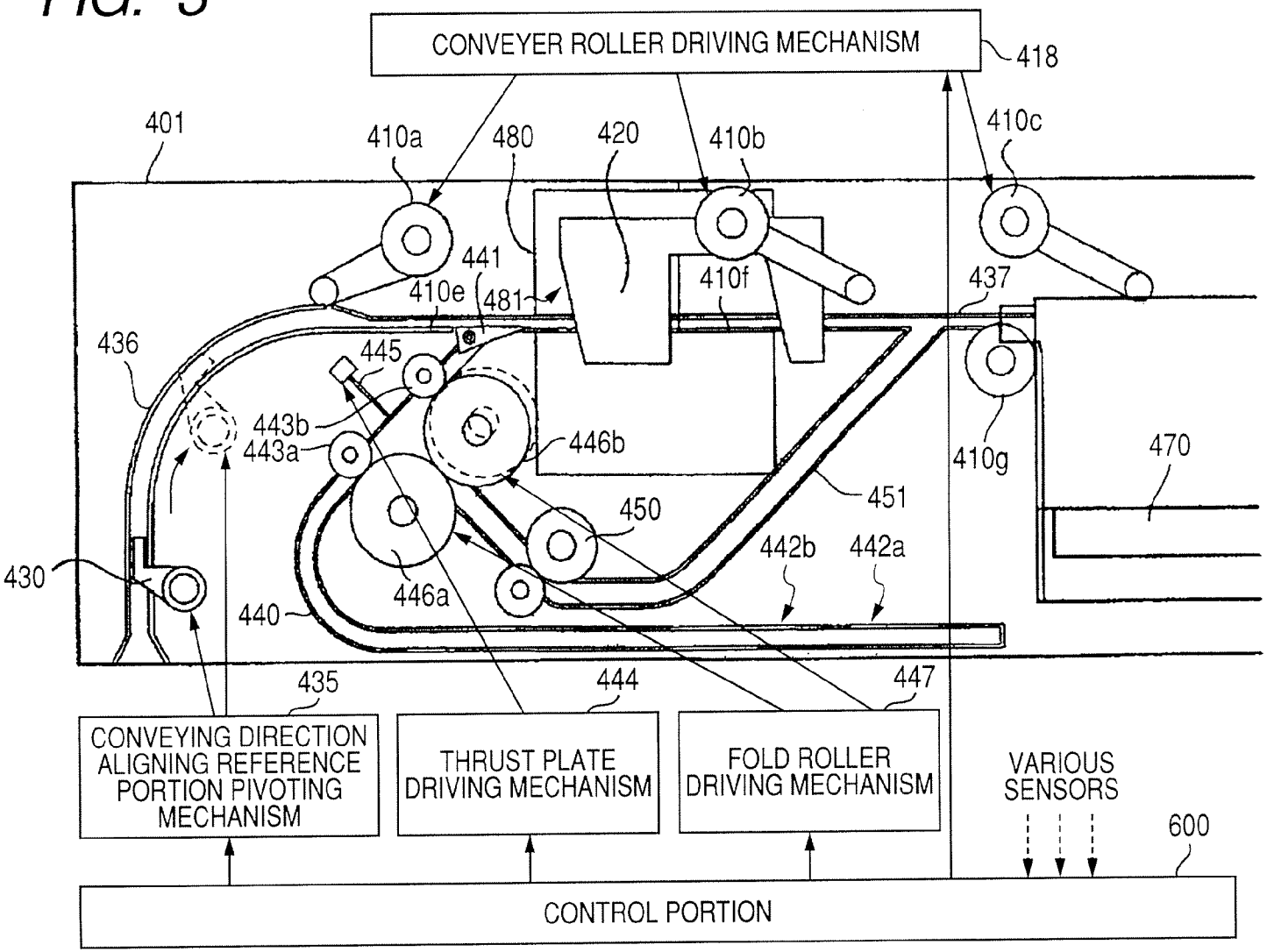
FIG. 3 shows the driving mechanism of the sheet processing apparatus.
Figure 4:
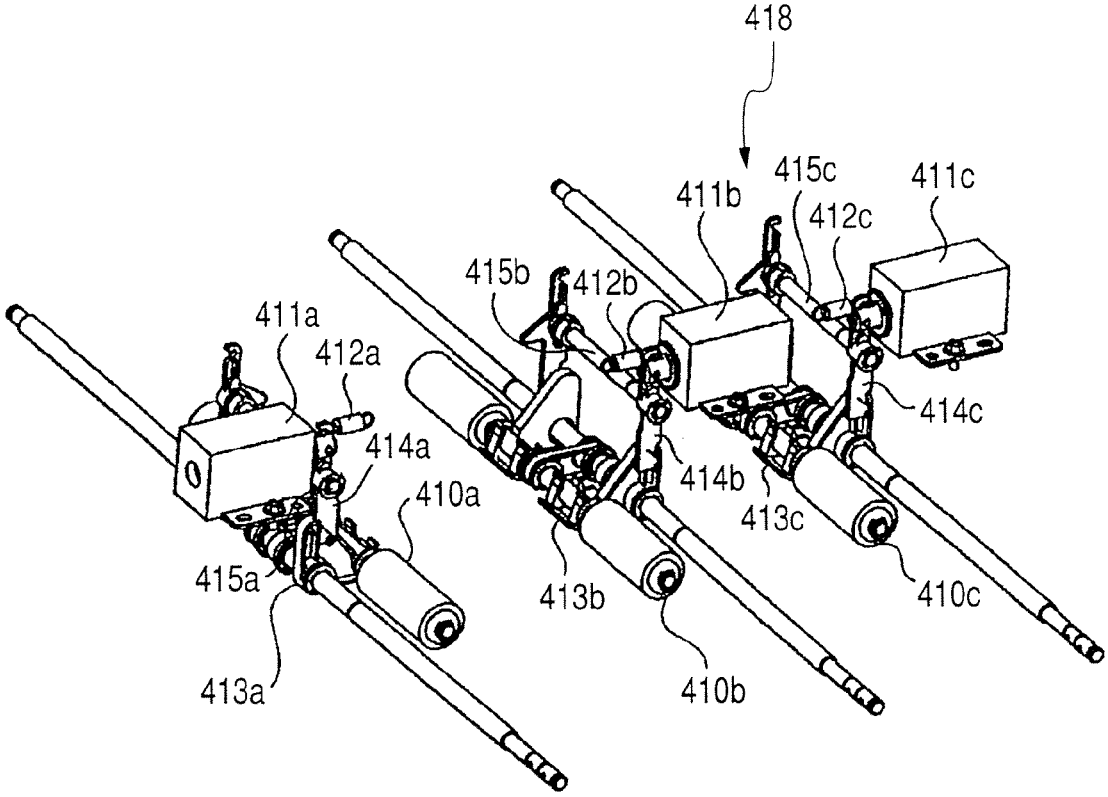
FIG. 4 is a perspective view of the driving mechanism of a conveyer roller.
Figure 5A:
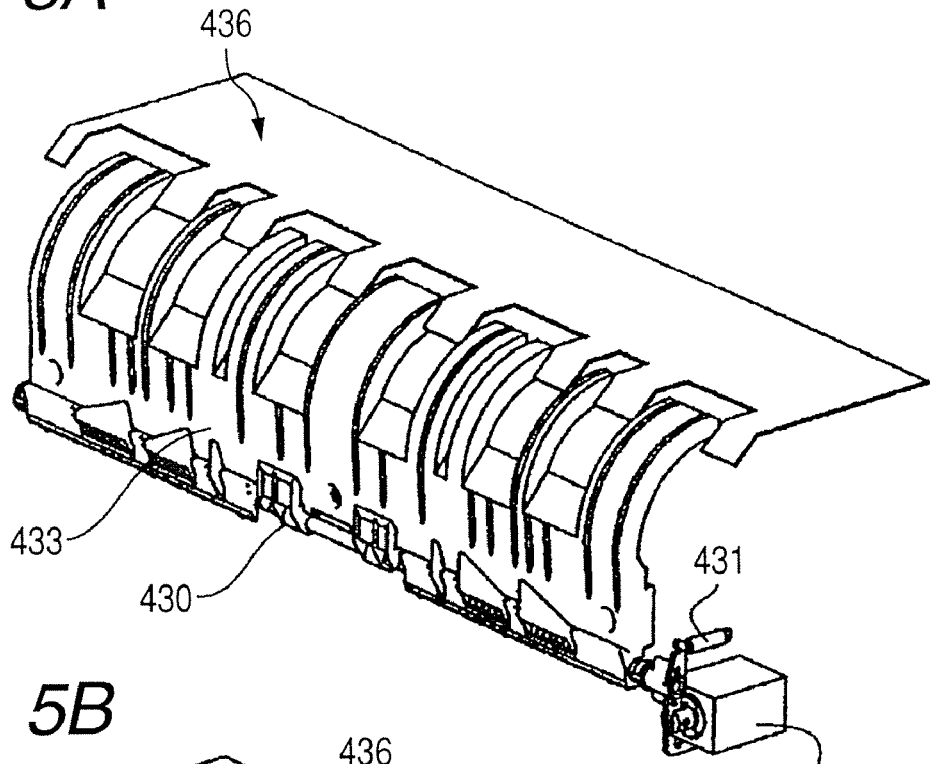
FIGS. 5A and 5B are illustrations of the positioning of a conveying direction aligning reference portion.
Figure 5B:
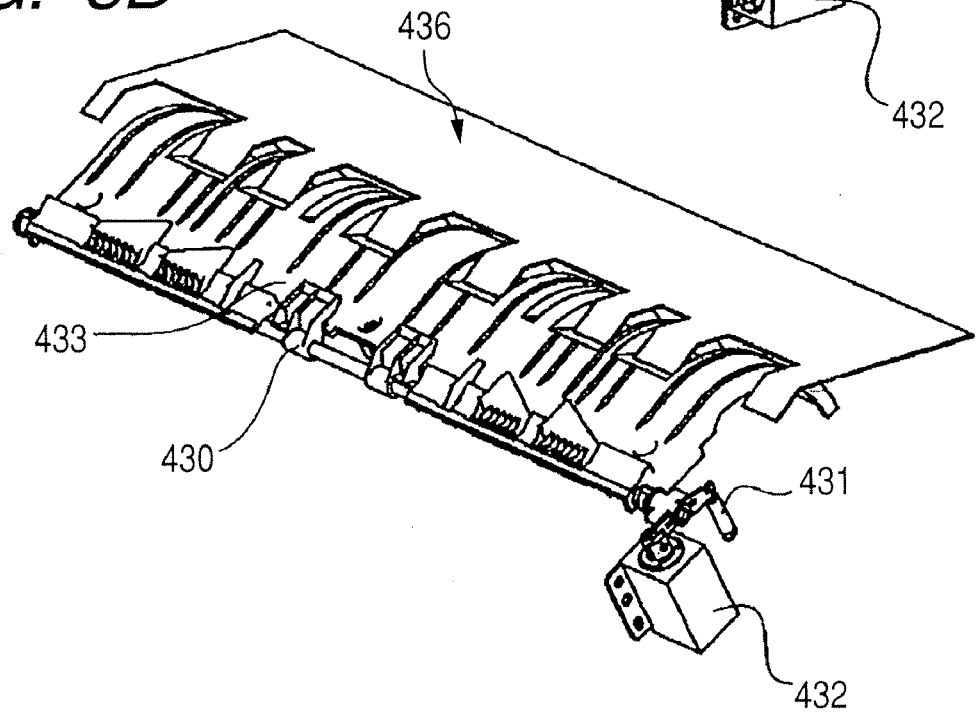
Figure 6A:
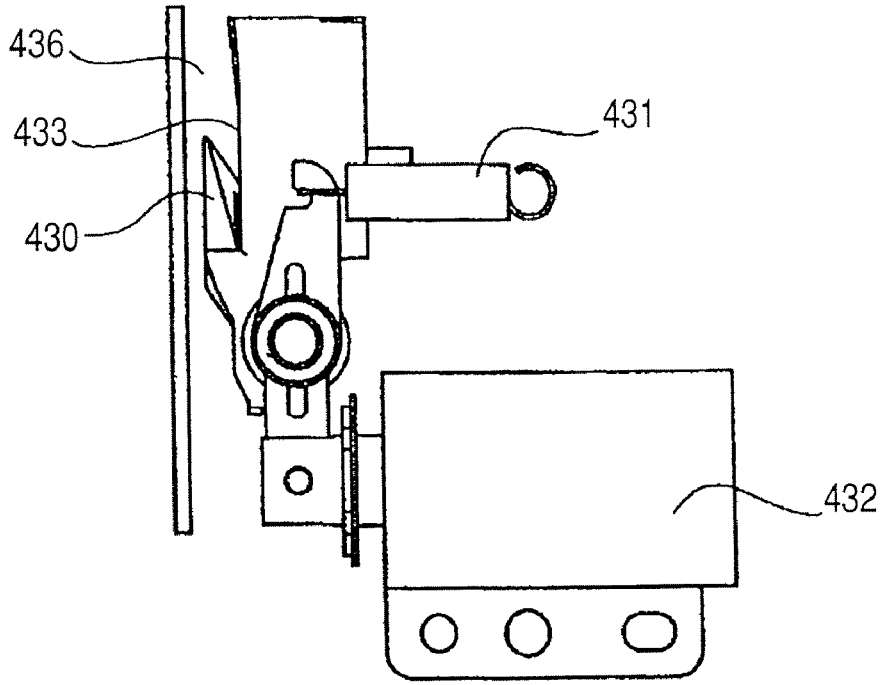
FIGS. 6A and 6B are illustrations of the operation of the conveying direction aligning reference portion.
Figure 6B:
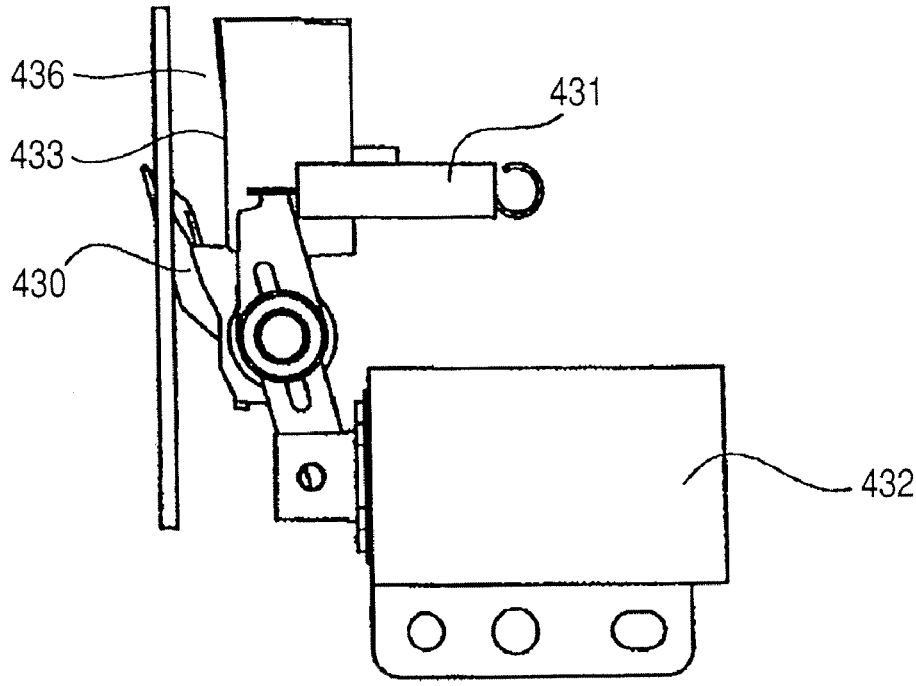

FIG. 2 is an illustration of the construction of the sheet processing apparatus, FIG. 3 shows the driving mechanism of the sheet processing apparatus, FIG. 4 is a perspective view of the driving mechanism of a conveyer roller, FIGS. 5A and 5B are illustrations of the positioning of a conveying direction aligning reference portion, and FIGS. 6A and 6B are illustrations of the operation of the conveying direction aligning reference portion. The sheet processing apparatus 400 according to the present embodiment is provided with e.g. the stacking portion 470 which is sheet stacking means, e.g. the conveying direction aligning reference portion 430 which is a bundle forming device, e.g. a stapler which is stapling means, e.g. a thrust plate 445 which is a two-fold device, e.g. a discharge roller 410*c* which is a discharging device, and e.g. a discharging path 451 which is a joining device.

As shown in FIGS. 2 and 3, the sheet discharged from the apparatus main body 500A is guided to the stapler 480 through a conveying path 436. When the simple stacking process is selected, the sheet passes the stapler 480 and is guided to the nip between the discharge roller 410*c* and a discharge runner 410*g* through a conveying path 437, and is discharged to the stacking portion 470 by the discharge roller 410*c* being rotated.

Conveyer rollers 410*a*, 410*b* and the discharge roller 410*c* for conveying the sheet along the ordinary conveying paths 436 and 437 are rotatively driven by a common pulse motor (not shown) and also, have their rotation controlled by a conveyer roller driving mechanism 418 shown in FIG. 4. The conveyer rollers 410*a*, 410*b* and the discharge roller 410*c* have their rotary shafts pivotally supported, and can contact with and separate from conveying path wall surfaces 410*e*, 410*f* and the discharge runner 410*g*, respectively, by a lift mechanism.

The conveying direction aligning reference portion 430 for aligning the sheet in the conveying direction is disposed on the entrance side of the conveying path 436. The conveying direction aligning reference portion 430 pinches the upstream side (trailing edges) of the sheets received into the conveying path 436 one by one and causes it to resist the friction of the succeeding sheets, and pinches the succeeding sheets one after another and superposes them one upon another, to thereby buffer a predetermined number of sheets in the conveying path 436 and form a sheet bundle.

The conveying direction aligning reference portion 430 is moved along the conveying path within a pivotally moved position indicated in FIG. 5A to a pivotally moved position indicated in FIG. 5B by a conveying direction aligning reference portion pivotally moving mechanism 435. The conveying direction aligning reference portion 430 is positioned at a pivotally moved position conforming to the size of the sheet by the conveying direction aligning reference portion pivotally moving mechanism 435 before the formation of the sheet bundle is started. In other words, by the conveying direction aligning reference portion 430 being positioned, the stapling position of the stapler 480 is automatically positioned on the central fold line of the sheet bundle nipped by the conveying direction aligning reference portion 430, and after the formation of the sheet bundle, the saddle stitching by the stapler 480 is immediately executed without additional positioning movement.

An aligning portion 420 is a pair of members supported for movement in a direction perpendicular to the plane of the drawing sheet, and is reciprocally moved to the interval of the sheet width to thereby align the width direction of the sheet (the side edge of the sheet). The discharge roller 410*c* is in pressure contact with the discharge runner 410*g* and constitutes a pair of discharge rollers, and discharges the sheet conveyed on the conveying path 437 and the end bound sheet bundle to the stacking portion 470 and stacks them thereon.

A conveying direction changeover portion 441 is disposed at a position upstream of the stapler 480. The conveying direction changeover portion 441 is upwardly pivotally moved to thereby open a branch-off path 440 after the saddle-stitched sheet bundle has been conveyed to the stapler 480, and makes the switchback conveyance of the sheet bundle to the branch-off path 440 possible.

Bundle folding rollers 446*a* and 446*b* are disposed near the entrance of the branch-off path 440. The bundle folding rollers 446*a* and 446*b* are rotatively driven by a folding roller driving mechanism 447, and the rotation direction thereof and the contact state therebetween are controlled.

The folding roller driving mechanism 447 supports the bundle folding roller 446*b* for pressure contact with and separation from the bundle folding roller 446*a*, and when the sheet bundle is to be folded in two, the bundle folding rollers 446*a* and 446*b* are brought into pressure contact with each other, but when the sheet bundle is to be conveyed toward the distal end side of the branch-off path 440, the bundle folding rollers 446*a* and 446*b* are separated from each other as indicated by broken line (FIG. 3). Also, the bundle folding roller driving mechanism 447 can change over the rotation direction of the bundle folding roller 446*a* to forward rotation in which it is rotated toward the nip between it and the bundle folding roller 446*b*, and reverse rotation in which it drives the sheet bundle toward the distal end side of the branch-off path 440.

Also, the folding roller driving mechanism 447 supports bundle conveying rollers 443*a* and 443*b* for contact with and separation from the bundle folding rollers 446*a* and 446*b*, and when the sheet bundle is to be conveyed toward the distal end side of the branch-off path 440, the bundle conveying rollers 443*a* and 443*b* are brought into pressure contact with the bundle folding rollers 446*a* and 446*b*, while on the other hand, when the sheet bundle is to be folded in two, the bundle conveying rollers 443*a* and 443*b* are separated from the bundle folding rollers 446*a* and 446*b* and the sheet bundle folded in two is drawn into the nip between the bundle folding rollers 446*a* and 446*b* without any resistance. A thrust plate 445 thrusts the sheet bundle into the nip between the bundle folding roller 446*a* and 446*b* and twice-folds the sheet bundle.

The branch-off path 440 is endowed with greater are on the more distal end side than the bundle folding rollers 446*a* and 446*b*, and is bent along the bottom surface of the housing structure 40, and in the case of A3 size, it holds the sheet bundle in a state in which it has been curved into a substantially U-shape along the branch-off path 440, and starts two-fold.

Light shielding sensors 443*a* and 442*b* disposed in the branch-off path 440 are disposed at positions for detecting the leading edges of sheet bundles of respective sheet sizes in a state in which the fold line of the sheet bundle is positioned at the nip between the bundle folding rollers 446*a* and 446*b*. A light intercepting sensor 481 disposed upstream of the stapler 480 is disposed at a position for detecting the trailing edge of the sheet bundle in a state in which the end binding position of the sheet bundle is positioned at the stapling position of the stapler 480.

As shown in FIG. 4, the conveyer rollers 410*a*, 410*b* and the discharge roller 410*c* are supported by conveyer roller supporting portions 413*a*, 413*b* and a discharge roller supporting portion 413*c*, respectively, and are raised away from the sheet by conveyer roller separating springs 412*a*, 412*b* and a discharge roller separating spring 412, respectively, when conveyer roller separation driving portions (electromagnetic solenoids) 411*a*, 411*b* and a discharge roller separation driving portion 411*c* are not driven.

When the conveyer roller separation driving portions 411*a*, 411*b* and the discharge roller separation driving portion 411*c* are electrically energized, drive transmission supporting portions 414*a*, 414*b* and 414*c* are pivotally moved about fulcrum shafts 415*a*, 415*b* and 415*c*, respectively, in a direction to further extend the conveyer roller separating springs 412*a*, 412*b* and the discharge roller separating spring 412*c*. Thereby, the engaged portions with conveyer roller supporting portions 413*a*, 413*b* and a discharge roller supporting portion 413*c* are retracted and the conveyer rollers 410*a*, 410*b* and the discharge roller 410*c* fall by operation of gravity.

When as shown in FIG. 6B, a conveying direction aligning reference driving portion (electromagnetic solenoid) 432 is operated, the conveying direction aligning reference portion 430 closes the conveying path 436 and abuts against a reversely conveyed sheet to thereby effect the alignment in the conveying direction.

The conveying direction aligning reference portion 430 is movable to a pivotally moved position conforming to the size of the sheet together with a guide plate 433, by a conveying direction aligning reference portion pivoting mechanism 435 (FIG. 3). FIG. 5A shows an aligning reference position when a sheet bundle of a large size is formed, and FIG. 5B shows an aligning reference position for a sheet of a small size.

As shown in FIG. 6A, the conveying direction aligning reference portion 430 is always pressurized in a direction to pinch the sheet, by a conveying direction aligning reference spring portion 431, and a pressurized state is kept between it and the guide plate 433 when the conveying direction aligning reference driving portion 432 is not operated, but when the conveying direction aligning reference driving portion 432 is operated, the conveying direction aligning reference portion 430 rises through the thickness direction of the conveying path 436, and becomes capable of receiving the sheet into the interval between the guide plate 433 and the conveying direction aligning reference portion 430 (FIG. 6B).

<Control of the Sheet Processing Apparatus>

Figures 7, 7A:
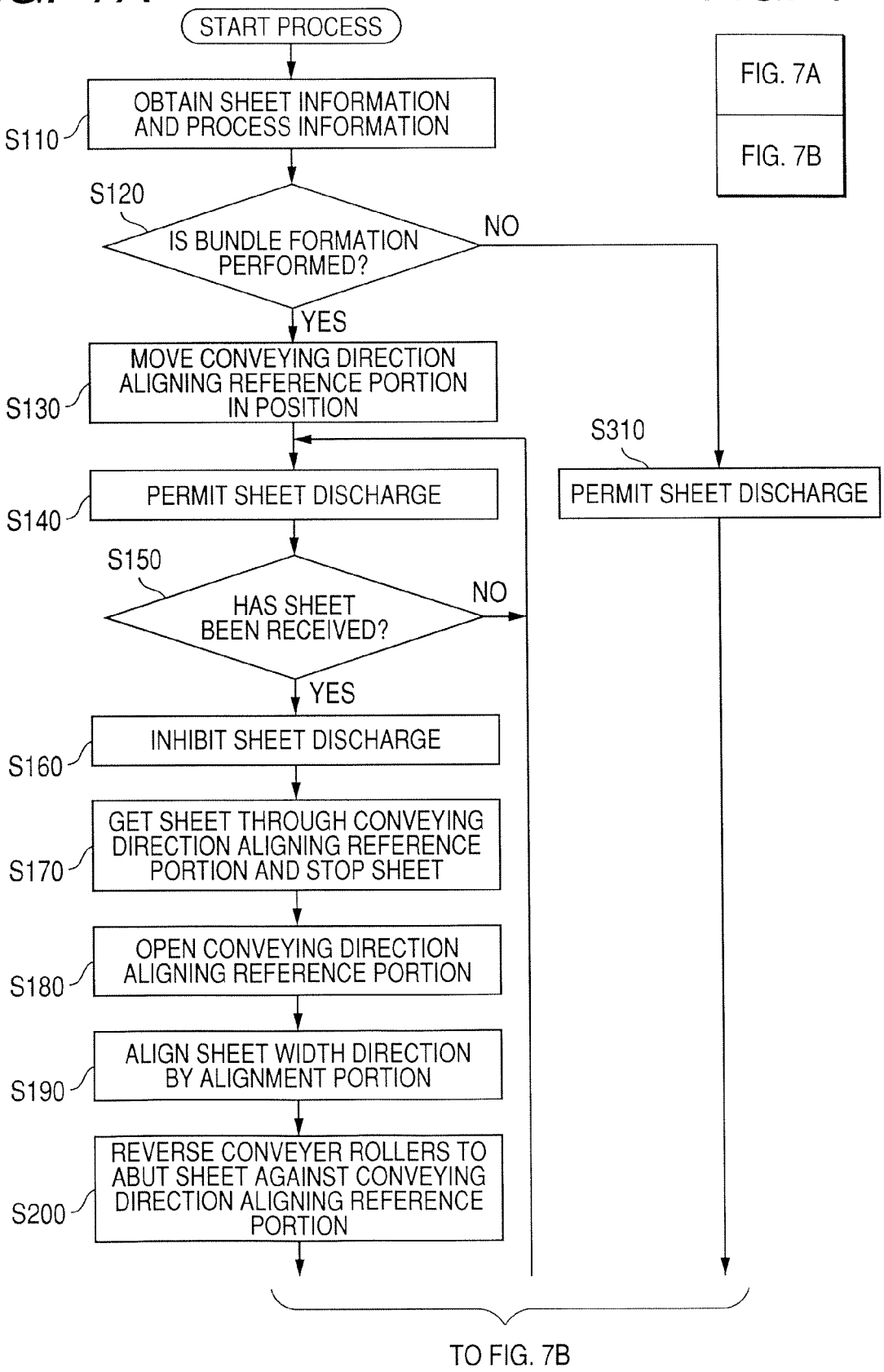
FIG. 7 is a flow chart of the control of the sheet processing apparatus.
Figure 7B:
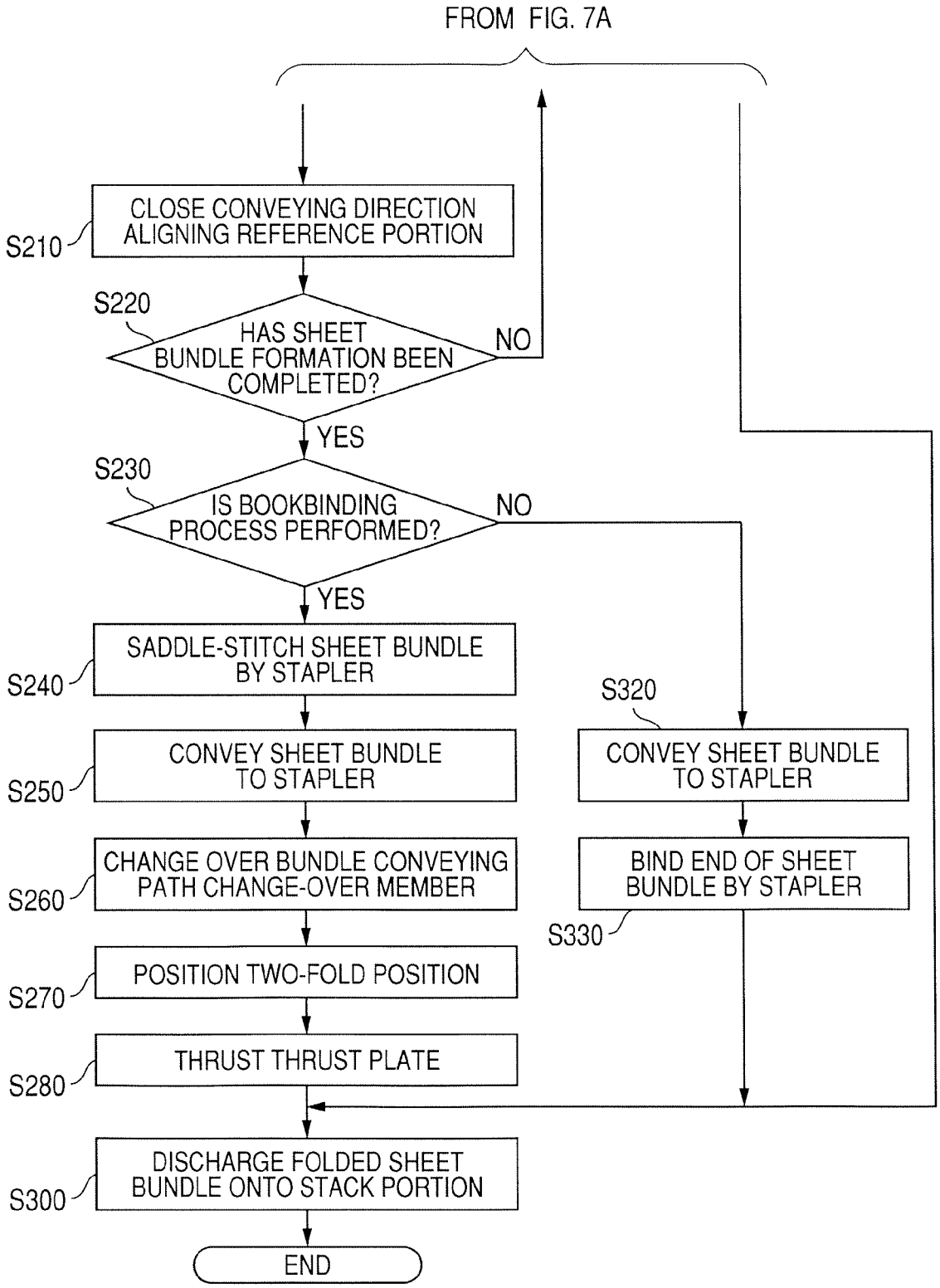
Figure 8A:
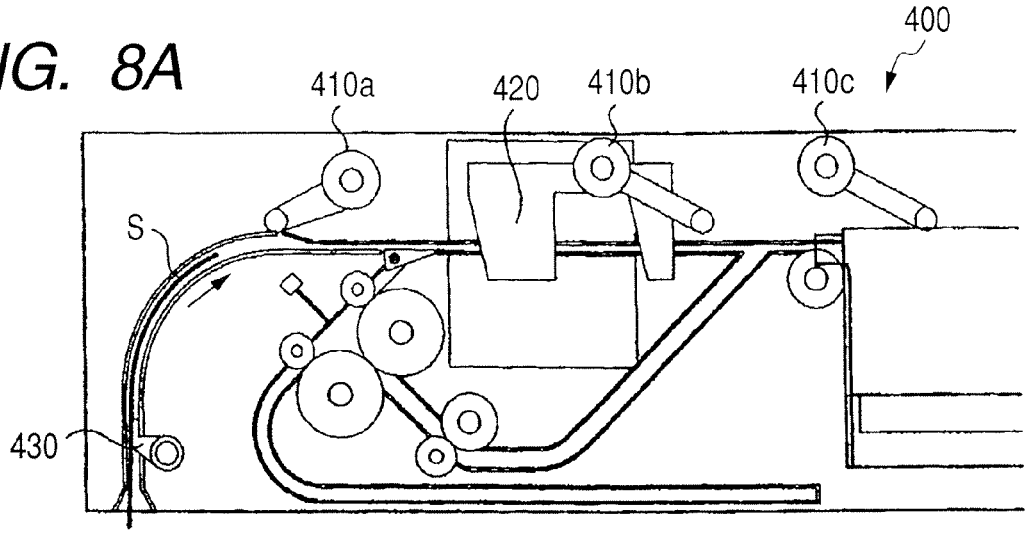
FIGS. 8A, 8B and 8C are illustrations of the operations of various portions from the reception of a sheet to the alignment in the width direction of the sheet.
Figure 8B:
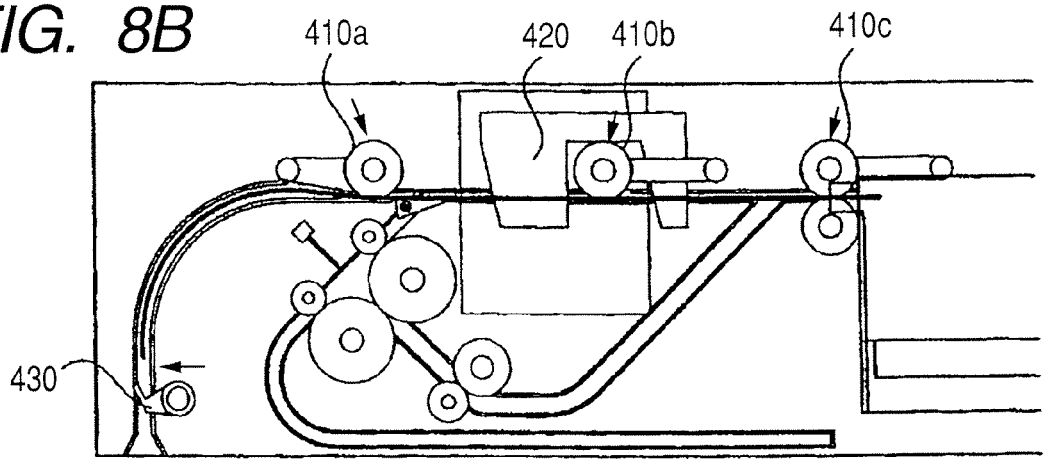
Figure 8C:
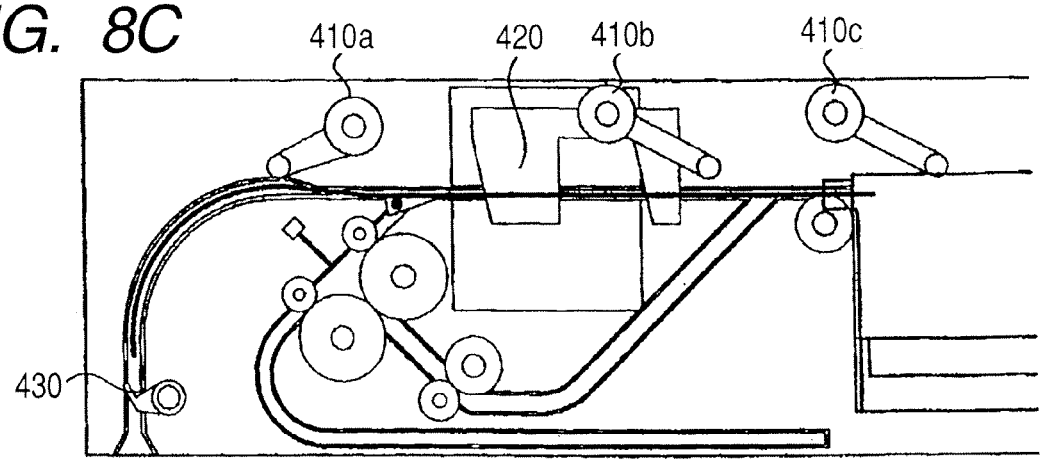
Figure 9A:
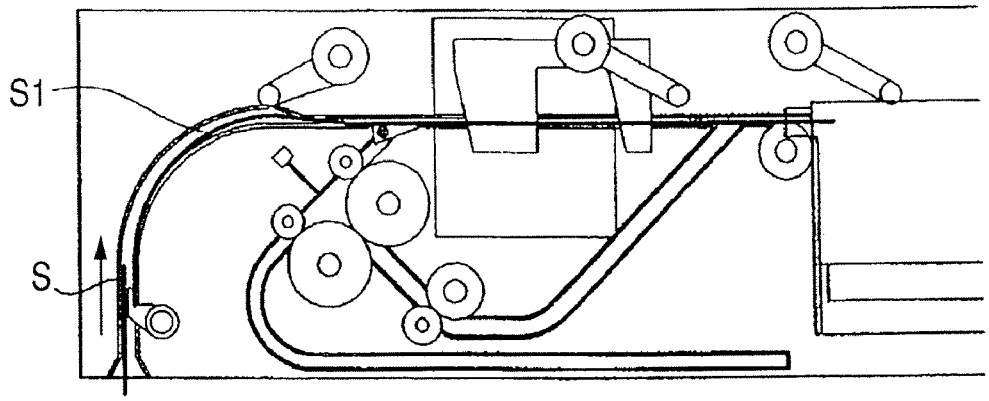
FIGS. 9A, 9B and 9C are illustrations of the operations of the various portions from the formation of a sheet bundle to the positioning of a fold line.
Figure 9B:
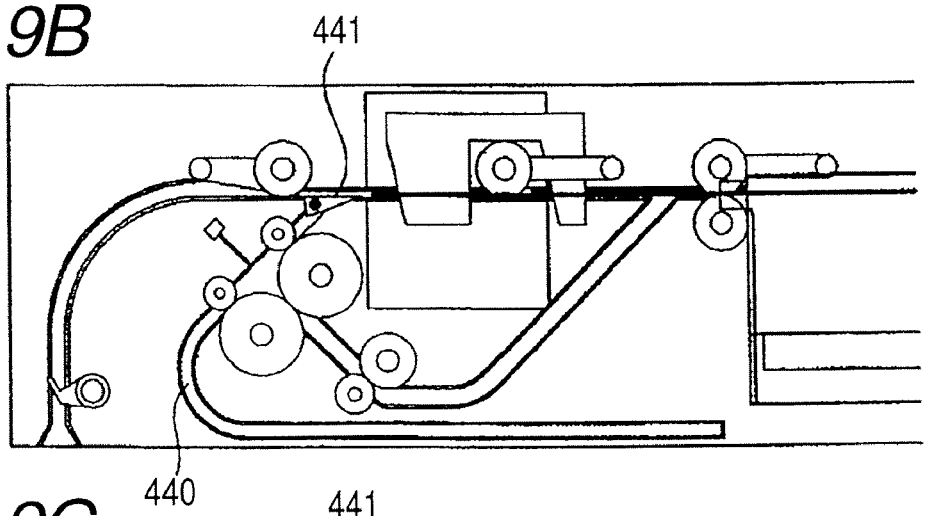
Figure 9C:
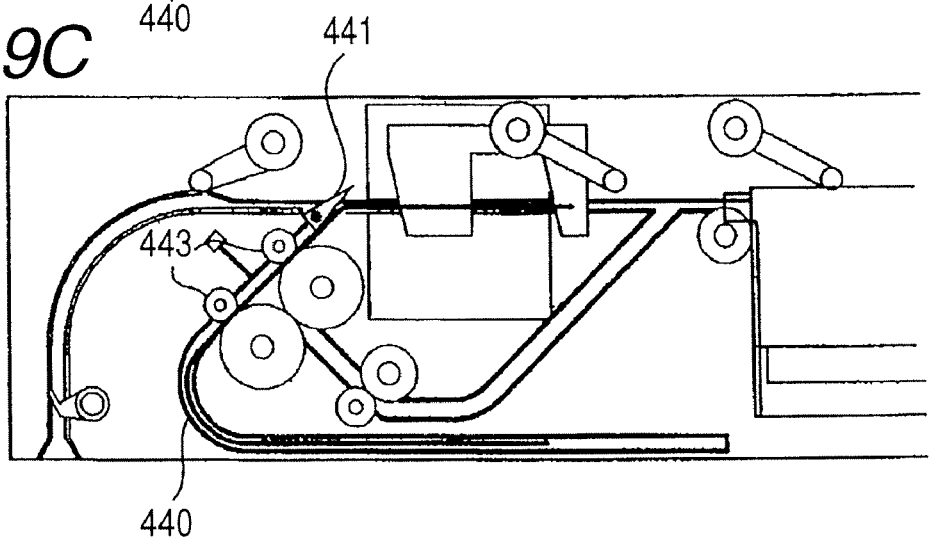
Figure 10A:
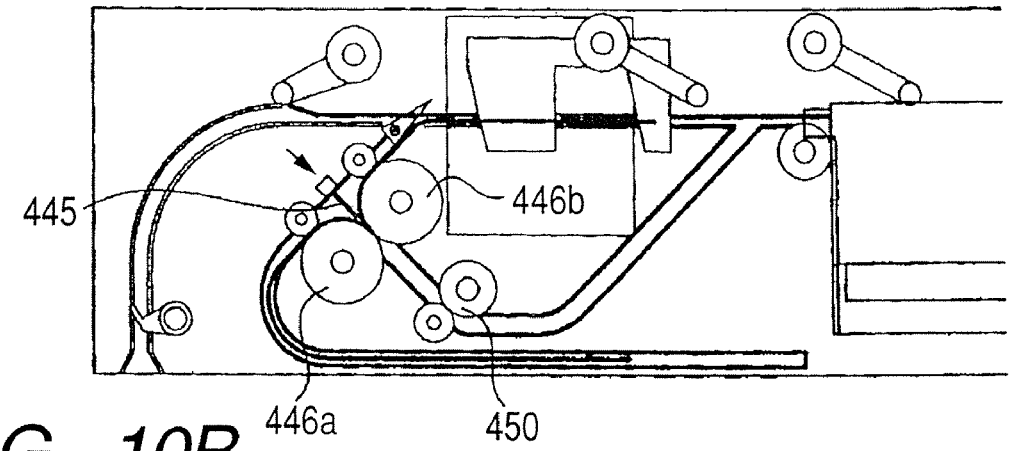
FIGS. 10A, 10B and 10C are illustrations of the operations of the various portions from the two-fold to the discharge of the sheet bundle.
Figure 10B:
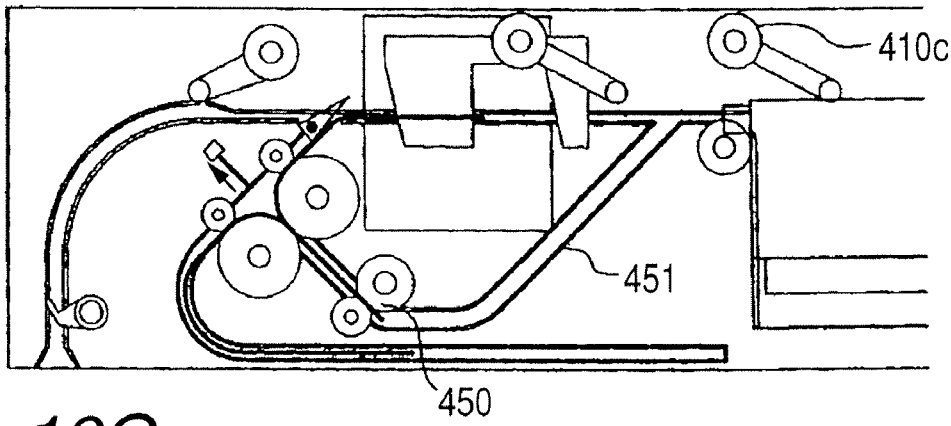
Figure 10C:
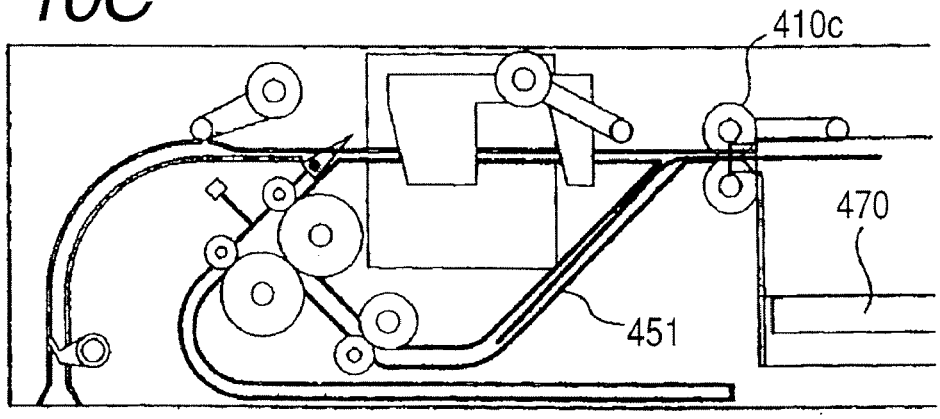

FIG. 7 is a flow chart of the control of the sheet processing apparatus. FIGS. 8A, 8B and 8C are illustrations of the operations of various portions from the reception of the sheet to the alignment of the width direction. FIGS. 9A, 9B and 9C are illustrations of the operations of the various portions from the formation of a sheet bundle to the positioning of the fold line. FIGS. 10A, 10B and 10C are illustrations of the operations of the various portions from the folding of the sheet bundle in two to the discharge of the sheet bundle.

A control portion 600 which is a microcomputer control device carried on the apparatus main body 500A of the copying machine 500, as shown in FIG. 1, controls the reader portion 120 to thereby make it read the image of an original, and controls the printer portion 200 to thereby make it form an image on a sheet. If the sheet processing apparatus 400 is connected to the apparatus main body 500A, the control portion 600 controls each portion of the sheet processing apparatus 400 to thereby make it execute designated processing.

As shown in FIG. 3, the control portion 600 has written therein the processing programs of image formation, original reading and sheet processing and data necessary for the execution of the programs, but the image formation and the original reading need not be described in detail, and only the sheet processing will hereinafter be described with reference to the flow chart of FIG. 7.

The control portion 600 reads out and holds the program of the written-in sheet processing and various data, effects necessary data transmission and reception between it and an external device, reads in various sensors and communication data in accordance with the program and executes necessary calculation, and operates various motors and actuators to thereby make them execute selected sheet processing.

Referring to FIG. 3, when as shown in FIG. 7, the sheet processing is selected through an operation panel (not shown) and the start of image formation is commanded, the control portion 600 obtains sheet information such as the sheet size and processing information such as designated processing contents (S110), and judges whether they include bundle formation (S120).

Then, in the case of the bookbinding process and the end binding process (YES at S120), the conveying direction aligning reference portion pivoting mechanism 435 is operated to thereby position the conveying direction aligning reference portion 430 at a pivotally moved position according to the size of the sheet (S130), thereafter image formation and sheet discharge are permitted (S140), and the reception of the sheet is waited for (S150).

The sheet S discharged from the apparatus main body 500A, as shown in FIG. 8A, arrives at the sheet processing apparatus 400 (YES at S150). In order to perform the following aligning operation for the sheet, the discharge of the next sheet is inhibited (S160). The conveyer rollers 410*a* and 410*b* have been retracted away from the sheet S, and when the sheet S comes into the sheet processing apparatus 400, these rollers start to rotate in a forward direction and fall, and as shown in FIG. 8B, they nip the sheet S therebetween and conveys the sheet S downstream to the aligning portion 420. Thereby, the sheet S is passed through the conveying direction aligning reference portion 430, and thereafter is stopped (S170).

When the sheet S is conveyed to a predetermined position in the aligning portion 420, the conveying direction aligning reference portion 430 is protruded so as to close the conveying path, by the conveying direction aligning reference driving portion 432. That is, the conveying direction aligning reference portion 430 is opened (S180). The conveyer rollers 410*a* and 410*b*, as shown in FIG. 8C, are stopped and retracted away from the sheet S. Subsequently, the conveying direction aligning portion 420 is reciprocally moved in the width direction by a driving mechanism to thereby effect the alignment in the width direction (S190).

When the alignment in the width direction is completed, as shown in FIG. 8B, the conveyer rollers 410*a* and 410*b* fall again and are rotated in a reverse direction for a predetermined time, and abuts the sheet S against the conveying direction aligning reference portion 430 to thereby effect the alignment in the conveying direction (S200). A conveying force F given to the sheet S by the conveyer roller 410*b* at this time is suppressed to such a degree that the sheet S is not buckled, and after the sheet S has been pushed against the conveying direction aligning reference portion 430, the conveyer roller 410*b* is idly rotated on the surface of the sheet S to thereby eliminate the skew feed of the sheet S.

After the stoppage of the conveyer roller 410*b*, the conveying direction aligning reference portion 430 is closed and the conveying direction aligning reference side (trailing edge) of the sheet S is pinched (S210). The conveyer roller 410*b* is upwardly retracted and separates from the sheet S. The control portion 600 judges whether the formation of a bundle of predetermined number of sheets has been completed (S220), and if it is not completed (NO at S220), the control of S140 to S220 is repeated. That is, the control portion 600 repeats the operation of FIGS. 8A to 9A until the formation of a bundle of a predetermined number of sheets is completed, and superposes the succeeding sheet S on the preceding sheet and integrally pinches them to thereby form a sheet bundle S1.

The conveying path 436 and the conveying direction aligning reference portion 430 are designed such that a space is formed in the conveying path 436 even in a state in which about 10 to 20 sheets S are pinched, and the succeeding sheet S discharged from the apparatus main body 500A is conveyed on the sheet S nipped by the conveying direction aligning reference portion 430, by the conveyer rollers 410*a* and 410*b*, and alignment and bundle formation are repetitively effected, whereby as shown in FIG. 9A, the sheet bundle S1 is formed in the conveying path 436 including the conveying direction aligning reference portion 430.

When the accumulation of a predetermined number of sheets S is completed (YES at S220), whether the job is the bookbinding process is judged (S230), and if it is the bookbinding process (YES at S230), the stapler unit 480 is operated while the sheet bundle S remains pinched by the conveying direction aligning reference portion 430, whereby a stapling process is automatically executed on the central fold line of the sheet bundle S1 (S240).

Next, the conveyer rollers 410*a* and 410*b* fall and nip the sheet bundle S1 therebetween and also, the conveying direction aligning reference portion 430 releases the nipping of the sheet bundle S1. Then, the conveyer rollers 410*a* and 410*b* are rotated in the forward direction, and as shown in FIG. 9B, they convey the sheet bundle S1 through the bundle conveying path changeover portion 441 to a position at which the light shielding sensor 481 becomes ON (the end binding position by the stapler 480) (S250).

When the sheet bundle S1 is stopped at the above-mentioned position, the bundle conveying path changeover portion 441 is upwardly deflected as shown in FIG. 9C (S260). The bundle folding rollers 446*a* and 446*b* are separated from each other, as indicated by broken line in FIG. 3, and start to be rotated in the same direction. Thereafter, the conveyer rollers 410*a* and 410*b* start to be rotated in the reverse direction, and the saddle-stitched sheet bundle comes into the changed-over branch-off path 440, is conveyed into the nip between the bundle folding roller 446*b* and the bundle conveying roller 443*b*, and is subsequently conveyed into the nip between the bundle folding roller 446*a* and the bundle conveying roller 443*a*. Then, the conveyance of the sheet bundle is entrusted to the bundle folding rollers 446*a* and 446*b*, and the conveyer roller 410*b* is upwardly retracted.

The sheet bundle conveyed by the bundle folding rollers 446*a* and 446*b* is more deeply advanced in the branch-off path 440, and as shown in FIG. 9C, is stopped from being conveyed at a position whereat the light shielding sensor 443*a* (442*b*) according to the size of the sheet becomes ON. Thereby, the two-fold position of the sheet bundle is positioned in accordance with the size of the sheet (S270).

Next, as shown in FIG. 10A, the thrust plate 445 pushes the fold line of the sheet bundle S1 into between the bundle folding rollers 446*a* and 446*b* (S280), and folds the sheet bundle S1 in two. At this time, the conveyer rollers 410*a*, 410*b* and the bundle conveying roller 443 are separate from the sheet.

However, the conveyer rollers 410*a*, 410*b* and the bundle conveying roller 443*a* may be rotatively driven in a direction to push the sheet bundle S1 into the nip between the bundle folding rollers 446*a* and 446*b*. In this case, the rotating speed of the bundle folding rollers 446*a* and 446*b* may be set to a low value roughly corresponding to the thrusting speed of the thrust plate 445 so that the bundle folding may be executed without the sheet bundle slipping much relative to the bundle folding rollers 446*a* and 446*b*.

Next, the sheet bundle S1 folded by the bundle folding rollers 446*a* and 446*b*, as shown in FIG. 10B, is conveyed to the bundle conveying portion 450, and is conveyed to the nip between the discharge roller 410*c* and the discharge runner 410*g* by the bundle conveying portion 450, and is discharged onto the stacking portion 470 by the discharge roller 410*c*, as shown in FIG. 10C (S300).

Now, in the case of the end binding process (NO at step S230), as shown in FIG. 9B, the sheet bundle is conveyed to and stopped at the end binding position by the stapler 480 (S320), and the stapler 480 is operated to thereby effect the end binding (S330). This end binding position is the turn-back position of conveyance in the bookbinding process, as described above.

Also, when bundle formation is not done (NO at S120), sheet discharge permission is given (S310), and the conveyer rollers 410*a*, 410*b* and the discharge roller 410*c* are rotated in contact with one another, and the sheets are discharged one by one to the stacking portion 470 and are simply stacked thereon.

Another Embodiment

Figure 11:
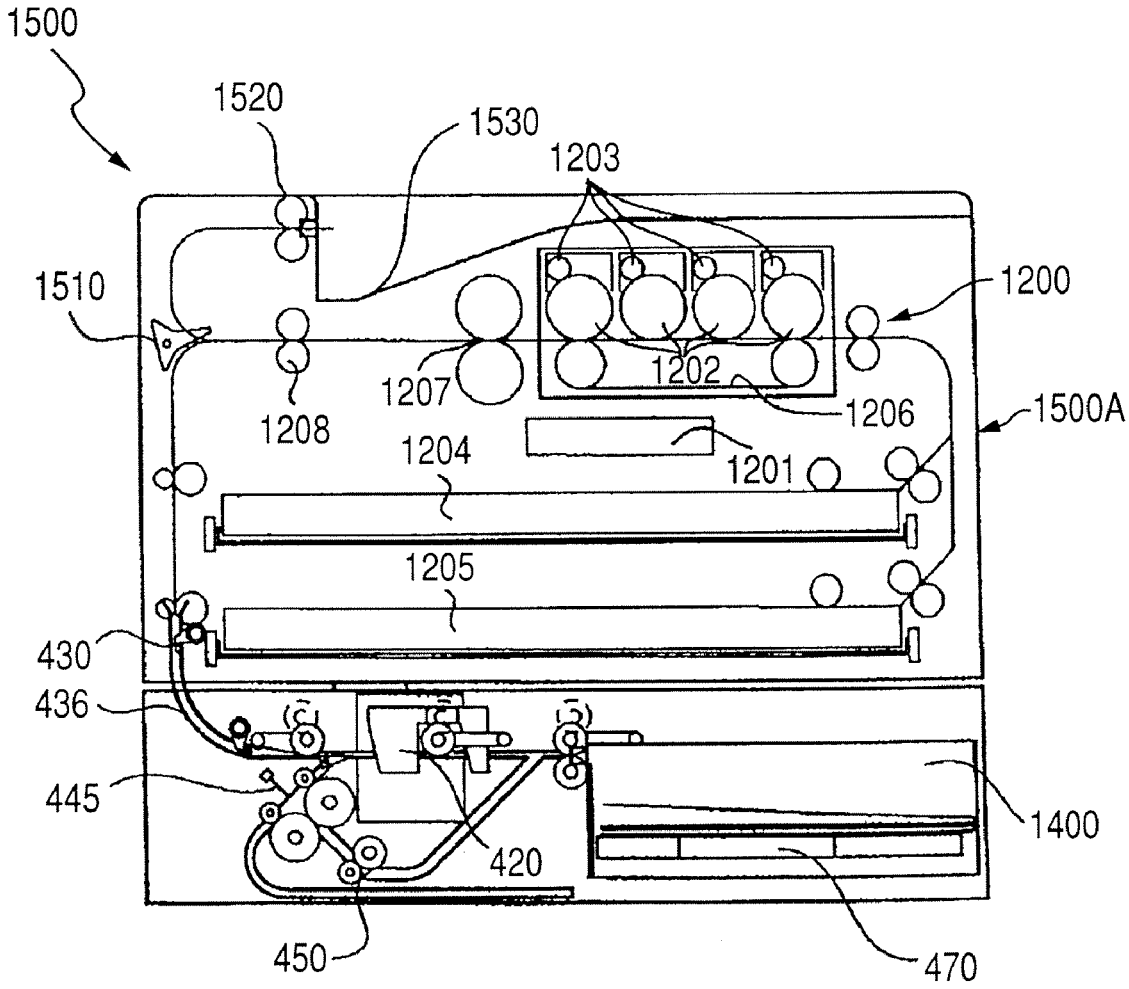
FIG. 11 is an illustration of the construction of an image forming apparatus according to another embodiment.

FIG. 11 is an illustration of the construction of an image forming apparatus according to another embodiment. In this embodiment, below the apparatus main body 1500A of a color printer 1500, there is disposed a sheet processing apparatus 1400 equal in operation and function to the sheet processing apparatus 400 described with reference to FIGS. 1 to 10C. In FIG. 11, members equal in function to those in the sheet processing apparatus 400 described with reference to FIGS. 1 to 10C are given the same reference characters and need not be described in detail.

As shown in FIG. 11, the apparatus 1500A of the color printer 1500 has a printer portion 1200 which can form color images on sheets taken out one by one from a sheet cassette 1204 (or 1205). A stacking tray 1530 is formed on the upper surface of the apparatus main body 1500A. The sheets on which the images have been formed by the printer portion 1200 can be directly discharged to and stacked on the stacking tray 1530. Four photosensitive drums 1202 corresponding to cyan, magenta, yellow and black are arranged in a row in the printer portion 1200, and exposure heads (not shown) and developing devices 1203 are disposed for the four photosensitive drums 1202.

In the color printer 1500 of such a construction, when original data is to be received from an external device such as a personal computer to thereby form an image, the exposure heads are operated on the basis of the original data transmitted from the personal computer or the like, and latent images are formed on the photosensitive drums 1202. The formed latent images are developed by the developing devices 1203, whereby toner images of the respective colors are formed on the photosensitive drums 1202.

The cyan, magenta, yellow and black toner images formed on the four photosensitive drums 1202 by the use of the exposure heads and the developing devices 1203 are successively transferred to the surface of the sheet conveyed by a conveyer belt 1206, and are subjected to heating and pressurization by a fixing portion 1207, and are fixed thereon. The sheet on which the image has been formed is advanced from a discharging portion 1208 to a conveying path changeover portion 1510, and is downwardly guided by the upwardly deflected conveying path changeover portion 1510 and comes into the sheet processing apparatus 1400.

The sheet processing apparatus 1400 is constructed substantially similarly to the sheet processing apparatus 400 of FIG. 1 with the exception that the conveying path 436 is upwardly formed in accordance with a sheet receiving direction, and that from the convenience of the disposition space, the conveying direction aligning reference portion 430 is disposed on the apparatus main body 1500A side, and is likewise controlled and can execute similar processing, namely, can select and execute one of three processes, i.e., the simple stacking process of discharging the sheets on which images have been formed one by one to the stacking portion 470 and stacking them thereon, the end binding process of superposing the sheets on which the images have been formed one upon another to thereby form a sheet bundle and staple one end thereof, and the bookbinding process of saddle-stitching the center of the formed sheet bundle, and thereafter folding the sheet bundle in two.

In a case that these processing are not carried out, the conveying path changeover portion 1510 is deflected downward to changeover the conveying path. The sheet on which the image is formed is discharged through an unprocessed sheet discharging portion 1520 to an unprocessed sheet stacking portion 1530 one by one so that the sheets are stacked on the unprocessed sheet stacking portion 1530.

It is also possible to substitute a kind of machine coping with two-side printing for the color printer 1500, and form images on the two sides of a sheet, and thereafter carry out the bookbinding process by the sheet processing apparatus 1400.

Further, like the image forming apparatus according to the embodiment described with reference to FIGS. 1 to 10C, again in another embodiment, an image forming apparatus of an electrostatic printing type can be mentioned as an example, and the same may be said of other image forming apparatuses, for example, an image forming apparatus using ink, and an image forming apparatus of an ink jet type, and the type of image formation does not matter.

Still Another Embodiment

FIGS. 12A, 12B, 12C and 12D are illustrations of the construction of an image forming apparatus according to still another embodiment. The sheet processing apparatus 400 according to the embodiment described with reference to FIGS. 1 to 10C permits various forms of mounting and connection with respect also to other apparatuses than the color printer 1500 of FIG. 11, simply by applying some changes to the conveying path 436, the conveying direction aligning reference portion 430, the housing structure 401, etc. thereof.

Figure 12A:
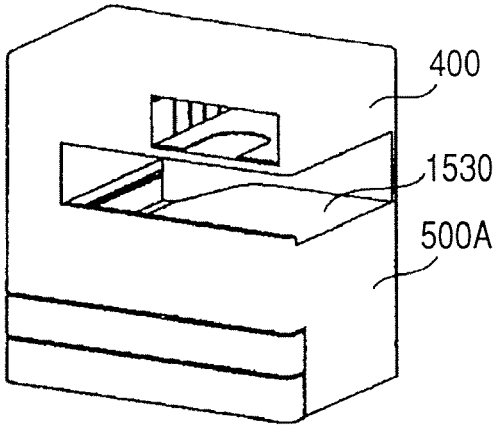
FIGS. 12A, 12B, 12C and 12D are illustrations of the construction of an image forming apparatus according to still another embodiment.

As shown in FIG. 12A, the sheet processing apparatus 400 may be disposed above the apparatus main body 500A to thereby give preference to the taking-out of the sheet bundle from the sheet processing apparatus 400. A brochure subjected to the bookbinding process is discharged to above the image forming apparatus main body 500A and therefore, such operability as the visual perceptibility or the taking-out property of the brochure is improved.

Figure 12B:
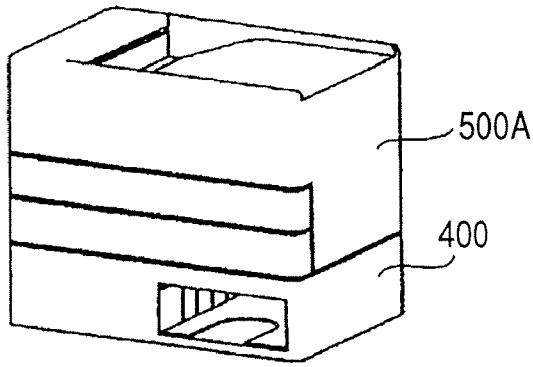

In the case of a printer which does not require the reader portion 120, as shown in FIG. 12B, a stacking tray similar to that of the color printer 1500 shown in FIG. 11 may be formed on the upper surface of the apparatus main body 500A to thereby make it cope with the simple stacking process for the sheets and also, the sheet processing apparatus 400 may be disposed under the apparatus main body 500A to thereby make the full height of the system small.

Figure 12C:
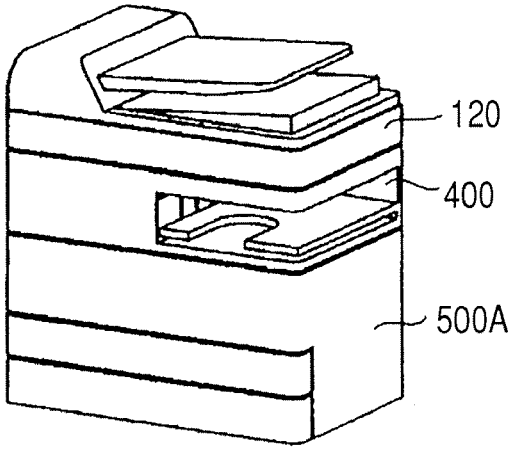

As shown in FIG. 12C, the sheet processing apparatus 400 may be gaplessly sandwiched between the reader portion 120 and the apparatus main body 500A to thereby give preference to the downsizing of the whole.

Figure 12D:
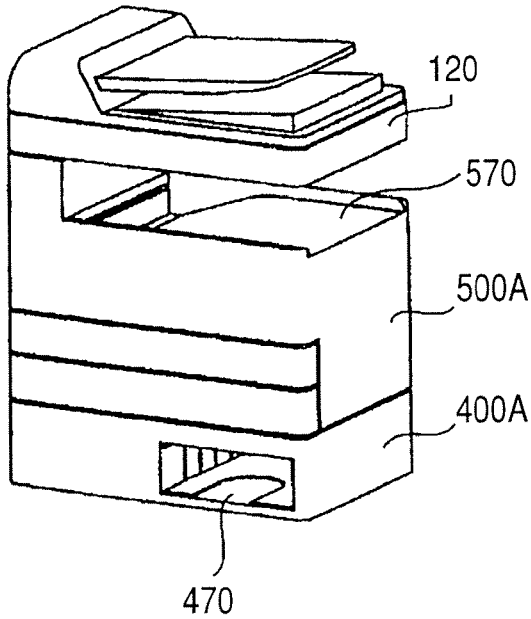

As shown in FIG. 12D, a stacking portion 570 for sheets of a large size may be provided between the reader portion 120 and the apparatus main body 500A so that only twice-folded sheet bundles may be stacked on the stacking portion 470, thereby achieving complete the in-body (complete in-the-plane) discharge.

Effects of the Sheet Processing Apparatus and Image Forming Apparatus According to the Embodiment As described above, the sheet processing apparatus 400 according to the present embodiment carries out the accumulating and aligning processes for the bookbinding process in the conveying path 436, and effects saddle stitching and two-fold, and thereafter conveys a brochure subjected to the bookbinding process from the bundle conveying portion 450 to the discharging path 451, effects the discharge of the unprocessed sheet by the use of the discharge roller 410*c* and at least a portion, and further uses at least a portion of the stacking portion 470, whereby a very compact bookbinding process portion can be constructed and therefore, it becomes possible to improve the degree of freedom of the layout of the sheet processing apparatus 400 relative to the apparatus main body 500A, and it becomes possible to provide an image forming apparatus system including the bookbinding process portion without spoiling the merits of the apparatus main body 500A such as, for example, being an image forming apparatus excellent in operability, and being a compact image forming apparatus.

The copying machine 500 according to the present embodiment has the sheet processing apparatus 400 disposed above the apparatus main body 500A and therefore, the brochure subjected to the bookbinding process is discharged to a higher position in the apparatus main body 500A than in a case where as in the color printer 1500 according to another embodiment, the sheet processing apparatus 1400 is disposed below the apparatus main body 1500A, and such operability as the visual perceptibility or the taking-out property of the brochure is improved.

The sheet processing apparatus 400 according to the present embodiment is designed such that (1) at least a portion of the sheet conveying portion for conveying the sheets for discharge and stacking, and the saddle-stitching portion for successively accumulating and aligning the sheets for the saddle-stitching process and thereafter, saddle-stitching the sheets and folding them into a brochure shape is used also to carry out the accumulating and saddle-stitching processes of the saddle-stitching process in the sheet conveying portion, (2) at least a portion of the sheet conveying portion, the brochure conveying portion, the sheet stacking portion and the brochure stacking portion is used also to accumulate the sheets in the sheet conveying portion and carry out the saddle-stitching process there, and the brochure subjected to the folding process again joins the sheet conveying portion the brochure conveying portion, and is discharged to the sheet discharging portion and the sheet stacking portion, (3) the accumulation of sheets of a large size is effected at the conveying direction aligning position for the aforementioned saddle-stitching, whereby even the sheets of a large size can be contained substantially in the occupying area of the image forming apparatus, and (4) during the alignment in the conveying direction, at least a portion of the conveying direction aligning reference portion which provides the conveying direction aligning reference, and the conveying portion for the aligned and saddle-stitched sheet bundle is used also to effect the conveyance of the sheet bundle in the conveying direction aligning reference portion, and therefore, as described above, the great compounding of functions is done by the designs mentioned under items (1) to (4) above and therefore, relative to a product of which the functions have been individually designed, the number of constituents becomes small, and the simplification of the mechanism and construction is done, and the downsizing and a lower cost are realized and thus, it has become possible to provide a compact and inexpensive product which is easy to install even in a limited space such as, for example, a desk side in an office or an ordinary home.

Also, the sheet processing apparatus 400 according to an embodiment of the present invention (1) is provided with a saddle-stitching bookbinding portion in the image forming apparatus, (2) has the saddle-stitching bookbinding portion disposed in a longitudinal direction with respect to the image forming portion, (3) has the saddle-stitching bookbinding portion designed to be within the projection area of the image forming portion, and (4) at least a portion of the stacking portion for the brochures subjected to the binding process by the saddle-stitching bookbinding portion is substantially within the projection area of the image forming portion.

Accordingly, as described above, by the constructions mentioned under items (1) to (4) above, the downsizing and lower cost of the sheet processing apparatus are realized irrespective of the presence or absence of the bookbinding portion. Thereby, it is possible to make the occupying area of the image forming apparatus substantially the same.

Also, by the saddle-stitching bookbinding portion being disposed in the longitudinal direction, the stacking portion can be disposed at a position which is best in the visual perceptibility and the taking-out property of the finished brochure and therefore, it becomes possible to provide a product which is good in usability to the user.

Now, in recent years, there has also been proposed a product in which a sheet processing apparatus for carrying out the end binding and sorting processes and a stacking portion for sheets of a small size are contained in the installation area of the image forming apparatus, but sheets of a large size protrude outwardly from the image forming apparatus. Also, when an ordinary user attempts to prepare a brochure, with regard to a brochure to be bound at an end portion thereof, although depending on the number of sheets to be bound, even a stapler of a handy type readily obtainable from an ordinary mass-sale store can be substituted for, whereas when an attempt is made to prepare a saddle-stitched brochure, a special stapling apparatus having a great span or a large-scale positioning apparatus is necessary, and it has been difficult to prepare a saddle-stitched brochure with ease. Consequently, there has been desired a product which can prepare a saddle-stitched brochure inexpensively.

The sheet processing apparatus 400 according to the present embodiment solves these problems and sufficiently satisfies the demand of the market, and the object thereof is to contain and dispose the sheet processing apparatus 400 capable of carrying out the bookbinding process increased with the spread of color printing within the occupying installation area of an image forming apparatus, to thereby provide a compact and inexpensive image forming apparatus and an image forming system including the image forming apparatus.

That is, the sheet processing apparatus according to the present embodiment guides a sheet bundle folded in two by the bundle folding rollers 446*a* and 446*b* by the discharging path 451, and discharges it from the same discharge roller 410*c* to the same stacking portion 470 as in the case of the simple stacking and end binding processes and therefore, it is unnecessary to discretely provide a discharge roller and a stacking portion exclusively for use for the bookbinding process. A space lower than the nip of the discharge roller 410*c* is utilized in common, and there can be realized a compact sheet processing apparatus 40 which can stack sheet bundles highly efficiently and in a great deal in both of the end binding process and the bookbinding process, and secures a stacking space provided with a practical capacity in the body and yet, suppresses the full height and the installation area.

Also, the conveying direction aligning reference portion 430 and stapler 480 used in the end binding process are intactly utilized in the bookbinding process with only the positioning of the sheet bundle made different and therefore, it is unnecessary to provide a conveying direction aligning reference portion and a stapler exclusively for use in the bookbinding process.

Also, the conveying direction aligning reference portion 430 utilized in common in the end binding process and the bookbinding process is disposed in the conveying path 436 for conveying the sheets not formed into a bundle to thereby effect bundle formation and therefore, the conveying path and the bundle forming portion become simple and compact and the number of necessary parts is greatly curtailed as compared with a case where discrete bundle forming portions are provided for the end binding process and the bookbinding process, or a bundle forming portion independent of the conveying path, which conveys the sheets not formed into a bundle is provided.

Also, the thrust plate 445 and the bundle folding rollers 446*a* and 446*b* are provided in the branch-off path 440 and therefore, the thrust plate 445 and the bundle folding rollers 446*a* and 446*b* can be disposed at positions avoiding the influence of the members and mechanisms disposed in the conveying paths 436 and 437, and the sheet bundle can be directed to a position which does not hinder the members and mechanisms disposed in the conveying paths 436 and 437 to thereby effect two-fold.

Also, the sheet bundle is caused to join the discharge roller 410*c* by the bundle conveying portion 450 and discharging path 451 disposed at positions separate from the conveying path 436 and therefore, the installation area is not increased, nor the conveyance distance of the sheet bundle is lengthened by these newly added members.

Also, two-fold is effected by a combination of the bundle folding rollers 446*a*, 446*b* and the thrust plate 445 backed up by the history and actual result thereof and therefore, the two-fold can be reliably effected with high accuracy and with a high yield.

Also, the discharge side of the bundle folding rollers 446*a* and 446*b* is set to the discharge roller 410*c* side and therefore, the discharging path 451 may be shorter than in a case where it is set to a discrete direction.

Also, the bundle folding rollers 446*a* and 446*b* are made separable from each other and reversible to thereby cause them to serve also as rollers for conveying the sheet bundle along the branch-off path 440 and therefore, rollers exclusively for use for conveyance are unnecessary.

Also, the branch-off path 440 is bent along the housing structure 401 at a location past the bundle folding rollers 446*a* and 446*b* and therefore, as compared with a case where it is not bent, the sheet processing apparatus 400 can be formed into a thin type.

Also, the nip of the discharge roller 410*c* is set at a high position, and a low space area downstream of the nip of the discharge roller 410*c* is allotted to the stacking portion 470 and is disposed in the body of the sheet processing apparatus 400 and therefore, a stacking portion which is high, wide and large as compared with the volume of the sheet processing apparatus 400 can be secured, and sheets of large sizes and a great deal of sheet bundles can be stacked thereon, and the full-load taking-out frequency can be decreased to thereby enhance the working efficiency, and the rate of operation of the copying machine 500 is also enhanced.

In spite of the in-body discharge, the stacking portion 470 of the sheet processing apparatus 400 of FIG. 1 is opened in its right side portion, and an accessory fixed tray is connected to the right side of the stacking portion 470, whereby the discharge and stacking of sheets of the same size as those in the sheet cassette 204 are also possible. That is, it is also possible to stack large-size sheets on the stacking portion 470 without carrying out the folding-in two process.

The conveying direction aligning reference portion 430 utilized in common in the end binding process and the bookbinding process is disposed in the conveying path 436 for conveying sheets not formed into a bundle, and the upstream side of the returned and conveyed sheets is pinched to thereby form a sheet bundle and therefore, the sheets are buffered in the sheet conveying path to thereby form a sheet bundle and thus, it is unnecessary to provide a sheet bundle forming space independent of the conveying path like the processing tray shown in Japanese Patent Application Laid-open No. 2001-72310. Also, the upstream side edge of the sheet is pinched by the pinch device to thereby resist the friction of the succeeding sheet and therefore, a bundle of a considerable number of sheets can be formed even in a narrow conveying path.

Also, the conveying direction aligning reference portion 430 is disposed at a position on the conveying path 436 in which the stapling position by the stapler 480 is positioned on the fold line of the nipped sheet bundle and therefore, immediately after the bundle formation, saddle-stitching can be executed, and there is not the fear that the bundle is conveyed and the alignment thereof is disturbed. On the other hand, in the case of the end binding, conveyance to the stapler 480 is effected, but the poorness of the accuracy of the end binding is not so conspicuous as in the case of the saddle stitching, and this does not pose a great problem.

Also, the conveying direction aligning reference portion 430 is positioned at a position according to the size of the sheet at which saddle stitching immediately becomes possible, by the conveying direction aligning reference portion pivoting mechanism 435, and therefore, even a sheet bundle of other size than A3 size can be subjected to the bookbinding process with accuracy and efficiency similar to those for A3 size.

Also, the conveying direction aligning reference portion 430 is pivotally moved to thereby effect positioning and therefore, can be contained in a narrower installation area than when it is translated.

The bundle folding rollers 446*a*, 446*b* and the thrust plate 445 are disposed in the branch-off path 440 branching off from the conveying path 436 toward the upstream side at the location between the conveying direction aligning reference portion 430 and the stapler 480 and therefore, the sheet bundle can be drawn back from the stapler 480 side and two-fold can be executed, and the movement distance of the sheet bundle before folded in two can be designed short (the interference area can be designed narrow).

Also, the branch-off path 440 branches off to the upstream side and therefore, when two-fold is to be effected with a portion of the sheet bundle before folded in two left in the conveying path 437, the resistance (bending and friction) when the sheet bundle is drawn into the branch-off path 440 with the two-fold becomes smaller than when the branch-off path 440 branches to the downstream side.

Also, the radius communicating the conveying path 437 and the branch-off path 440 together can be set smaller than when the branch-off path branches off to the downstream side and therefore, the bundle folding rollers 446*a* and 446*b* can be disposed at locations nearer to the conveying path 437 than when the branch-off path branches to the downstream side, and the full length of the branch-off path 440 is shortened, and the movement amount when the sheet bundle is positioned at the bundle folding rollers 446*a* and 446*b* may also be small.

Since the bundle folding rollers 446*a* and 446*b* are disposed in the branch-off path 440 independent of the conveying paths 436 and 437, the disposition of the instruments such as the stapler 480 and the conveyer rollers 410*a* and 410*b* on the conveying paths 436 and 437 is not effected, and the spatial disposition and performance of the bundle folding rollers 446*a* and 446*b* can be optimized, and a housing structure 401 of which the full height and installation area are reduced can be designed.

Also, the position at which the saddle-stitched sheet bundle is conveyed to the downstream side of the branch-off path 440 is a position at which the sheet bundle is end bound by the stapler 480 and therefore, positioning stop control can be executed by using a single light shielding sensor 481 in common.

Also, the sheet bundle folded in two by the bundle folding rollers 446*a* and 446*b* is guided by the discharging path 451, and is discharged from the same discharge roller 410*c* to the same stacking portion 470 as in the case of the simple stacking process or the end binding process and therefore, it is not necessary to discretely provide a discharge roller and a stacking portion exclusively for use in the bookbinding process. Thus, there can be realized a compact sheet processing apparatus 400 in which a space lower than the nip of the discharge roller 410*c* is utilized in common, and in both of the end binding process and the bookbinding process, sheet bundles can be stacked highly efficiently and in a great deal, and which secures a stacking space provided with a practical capacity in the body and yet, reduces the full height and the installation area.

There can also be provided an image forming apparatus which is provided with such a sheet processing apparatus, whereby which is capable of carrying out the bookbinding process and which can be designed with a small installation area and a small full height as well as with a small number of parts and light weight, and which is capable of carrying out a highly accurate bookbinding process and moreover, is inexpensive and highly reliable.

Also, the sheet processing apparatus 400 is disposed vertically between the apparatus main body 500A and the reader portion 120 and therefore, an image forming apparatus which does not require the sheet processing apparatus 400, an image forming apparatus which does not require the reader portion 120, and an image forming apparatus which carries out other special process than the bookbinding process can be easily realized by a combination of units of the same basic construction, and a lower price, high reliability and the refinement of design by the shortening of the new product input span are realized by the mass production of each unit.

Also, the control of the sheet processing apparatus 400 is effected by the use of the control portion 600 for controlling the apparatus main body 500A and therefore, the number of necessary microcomputer control devices may be smaller by one, and as compared with a case where a microcomputer control device exclusively for use for control is provided in the sheet processing apparatus 400, the housing structure 401 can be downsized and the degree of freedom of the disposition of the internal instruments heightens, and by adopting instrument disposition of high spatial efficiency, there can be realized an image forming apparatus which is compact but reasonable for sheet conveyance or the like.

In the sheet processing apparatus according to an embodiment, sheet bundles subjected to the bookbinding process are directed to the discharging device by the joining device, and are stacked on the sheet stacking means by the discharging device and therefore, the discharging device and the sheet stacking means used in the end binding process are intactly utilized to discharge and stack the sheet bundles subjected to the bookbinding process, and it is not necessary to discretely provide a discharging device and sheet stacking means exclusively for use therefor. Accordingly, there can be realized a compact sheet processing apparatus which utilizes a space lower than the discharging device in common and can highly efficiently stack sheet bundles in both of the end binding process and the bookbinding process, and secures a stacking space provided with a practical capacity in the body and yet, suppresses the full height and the installation area.

Also, the bundle forming device and the stapling means used in the end binding process are intactly utilized also in the bookbinding process with only the positioning of the sheet bundle made different and therefore, it is not necessary to provide a bundle forming device and stapling means exclusively for use in the bookbinding process.

In a sheet processing apparatus according to an embodiment, the sheets are buffered into the sheet conveying path to thereby form a sheet bundle and therefore, it is not necessary to provide a sheet bundle forming space independent of the conveying path like the processing tray shown in Japanese Patent Application Laid-open No. 2001-72310. Also, the upstream side edge of the sheet is pinched by the pinch device to thereby resist the friction of the succeeding sheet and therefore, a bundle of a considerable number of sheets can be formed even in a narrow conveying path.

Also, the copying machine 500 according to an embodiment is such that the sheet processing apparatus 400 is disposed in vertically superposed relationship with the image forming device with a plane outline made coincident with the plane outline of the apparatus main body 500A and therefore, the stock and estimated production amount of the apparatus main body 500A can be made small, and even the copying machine 500 small in demand which effects special sheet processing can be provided at a low price within a short time limit of delivery.

Also, the apparatus main body 500A having a great number of parts and many portions to be adjusted is universalized or standardized for mass production, whereby there can be provided a copying machine 500 of refined design, high quality and high reliability with the cost of parts and the assembly cost suppressed.

Also, the stacking portion 470 capable of stacking thereon A3 sheet bundles folded in two is provided in the plane outline of the apparatus main body 500A to thereby make sheet bundles subjected to the bookbinding process capable of being taken out from the stacking portion 470 to the front side and therefore, a stacking space provided with a practical capacity and making it easy to take out the sheets can be secured within a small full height and a small occupying area.

Also, the mechanism portion for processing the sheet is disposed aside toward one of the left and right sides as viewed from the front side, and the stacking portion 470 substantially corresponding to the full height of the sheet processing apparatus 400 is secured aside toward the side opposite to the mechanism portion and therefore, sheets or sheet bundles of a maximum thickness as viewed from the thickness of the sheet processing apparatus 400 can be stacked. Correspondingly to the increase in the stacking capacity of the stacking portion 470, the full load time has become late, and the frequent taking-out of the sheet bundles and the interruption of image formation accompanying the full load have become null. Accordingly, the running cost of the copying machine 500 including personnel expenses has been curtailed, and the rate of operation of the copying machine 500 has heightened, and the selection mistake of the sheet bundles accompanying the intermediate full load has decreased.

Also, the mechanism portion for processing the sheets is capable of carrying out a plurality of kinds of process to the sheets, and the stacking portion 470 is a space stacking thereon sheets and sheet bundles subjected to different kinds of processing in common and therefore, the convenience and commercial value of the sheet processing apparatus 400 have heightened and also, as compared with a case where the sheets and sheet bundles are stacked on a different place during each process, there could be provided a stacking portion 470 of a practical and sufficient stacking capacity.

Also, the discharge roller 410*c* is disposed above the stacking portion 470, and sheets and sheet bundles subjected to different kinds of processing are discharged to the stacking portion 470 through the intermediary of the discharge roller 410*c* and therefore, the stacking capacity of the stacking portion 470 can be enhanced by the maximum utilization of the height of the space lower than the nip of the discharge roller 410*c*.

Also, the stacking portion 470 is a space opened to both of the side put aside and the front side and therefore, as described above, the enlarged tray can be connected to the side to thereby cope with also the simple stacking process for A3 size, and the insertion range and insertion angle of the hand when the sheet bundle is taken out are enlarged to thereby enable the work of taking out the sheet bundle to be done easily and reliably, and the possibility of beating the sheet bundle against the wall surface of the stacking portion 470 when taking out them to thereby disturb the aligned state of the sheet bundles or scatter the sheet bundles on the floor has decreased.

Also, the mechanism portion for processing the sheets executes the end binding process and the bookbinding process and therefore, the conveying direction aligning reference portion 430, the stapler 480, the conveying paths 436, 437, the conveyer rollers 410*a*, 410*b*, the discharge roller 410*c* and the related mechanism of these can be utilized in common in the both processes to thereby decrease the number of parts.

Also, the mechanism portion for processing the sheets is disposed aside toward the left side as viewed from the front side and therefore, the sheet discharged from the ordinary apparatus main body 500A which effects image formation from right to left as viewed from the front side can be reasonably received by a conveying path 436 shorter than when the mechanism portion is put aside toward the opposite side. The stacking portion 470 is disposed aside toward the right side and therefore, the user can easily take out the sheet bundle by his right hand while standing in front of the copying machine 500, and this is convenient to the major right-handed users and thus, the demand for the apparatus becomes higher than in a case where the mechanism portion is put aside toward the opposite side.

Also, the sheet processing apparatus 400 is disposed above the apparatus main body 500A and therefore, the stacking portion 470 is located high by an amount corresponding to the thickness of the apparatus main body 500A, and the taking-out of the sheet bundle becomes easier than when the sheet processing apparatus is conversely disposed.

Also, the reader portion 120, the sheet processing apparatus 400 and the apparatus main body 500A are superposed in the named order from above and therefore, the upper air of the reader portion 120 is opened, and the setting of a bundle of originals onto the ADF 300 and the operation of bringing down the ADF 300 rearwardly and setting the originals can be naturally performed.

Also, the apparatus main body 1500A has the stacking tray 1530 formed on the upper surface thereof and therefore, even A3 size sheets difficult to stack only on the stacking portion 470 can be reasonably stacked by the use of the stacking tray 1530. The sheet processing apparatus 400 is disposed under the apparatus main body 1500A and therefore, the upper air of the stacking tray 1530 is opened, and the taking-out of the sheet bundle from the stacking tray 1530 is easier than when the sheet processing apparatus is conversely disposed.

Also, as shown in FIG. 12A, the sheet processing apparatus 400 is disposed above the apparatus main body 500A at an interval from the stacking tray 1530 and therefore, the stacking portion 470 becomes higher than in the arrangement of FIG. 12B wherein the sheet processing apparatus 400 is disposed under the apparatus main body 500A, and the taking-out of the sheet bundle becomes easy.

Also, the sheet processing apparatus 400 is made into a unit and therefore, can be interchanged with other processing unit formed into the same appearances and dimensions to thereby simply assemble a copying machine 500 for carrying out discrete processing.

The sheet processing apparatus 400 can carry out the bookbinding process inside the plane outline of the apparatus main body 500A, and can stack the processed sheet bundles on the stacking portion 470 inside the plane outline of the apparatus main body 500A. Accordingly, there can be realized a compact sheet processing apparatus which secures the stacking portion 470 provided with a practical capacity in the body and yet, of which the full height and the installation area are suppressed.

Also, the conveying paths 436, 437, the conveying direction aligning reference portion 430, the stapler 480, the conveyer rollers 410*a*, 410*b*, the discharge roller 410*c* and the related mechanism of these are utilized in common in the both processes and therefore, a sheet processing apparatus 400 given the end binding function for wide use and in addition, a convenient additional function and having a high commercial value can be realized with a small number of parts and lightly in weight as well as compactly.

Also, the conveying direction aligning reference portion 430 makes the sheets received into the conveying path 436 move reversely and pinches them one after another to thereby effect bundle formation in the conveying path 436 against the conveyance of the succeeding sheet and therefore, such a special place (processing tray) as shown in Japanese Patent Application Laid-open No. H10-279163 and Japanese Patent Application Laid-open No. 2001-72310 becomes unnecessary, and there can be realized a compact sheet processing apparatus which has eliminated a disposition space or the like for the processing tray.

The present invention is applicable not only to a copying machine and a printing machine, but also to every product using an image forming apparatus, for example, a facsimile apparatus.

The image forming apparatus according to an embodiment can vertically combine an image forming device and processing means together in a custom-made fashion to thereby carry out not only the bookbinding process, but also necessary sheet processing.

In the sheet processing apparatus according to an embodiment, various kinds of processing including bundle formation are carried out with sheets moved inside the plane outline of the image forming apparatus, and the processed sheet bundles are stacked on the sheet stacking means provided inside the plane outline of the image forming apparatus and therefore, an installation space and a working space for the sheet processing apparatus are unnecessary outside the image forming apparatus. The sheet stacking means is disposed toward one of the left and right sides of the plane outline and therefore, there can be realized a compact sheet processing apparatus which secures the sheet stacking means provided with a practical capacity in the body and yet, of which the full height and the installation area are suppressed.

While the present invention has been described with respect to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Applications Nos. 2005-261369 filed Sep. 8, 2005 and 2005-261370 filed Sep. 8, 2005, which are hereby incorporated by reference herein in their entirety.

What is claimed is:

1. A sheet processing apparatus comprising:

a stapler;

a conveying path along which a sheet is conveyed to said stapler;

a bundle forming device disposed in said conveying path for superposing received sheets one upon another to form a sheet bundle, said bundle forming device having a pinch device, which successively pinches an upstream end portion of the sheet one-by-one and integrally pinches a plurality of sheets;

a control portion, which controls said stapler and said bundle forming device to staple the sheet bundle by said stapler selectively between at one end of the sheet bundle in a conveying direction of the sheet bundle for a side stitching of the sheet bundle, and on a fold line of the sheet bundle for a saddle-stitching of the sheet bundle;

a discharging device, which discharges the sheet bundle stapled at the one end;

a stacking portion on which the sheet bundle discharged by said discharging device is stacked;

a two-fold device, which folds the sheet bundle stapled on the fold line in two along the fold line, wherein the sheet bundle folded by said two-fold device is stacked on said stacking portion; and a housing structure in which said stacking portion is disposed, wherein said stacking portion is defined in a space area downstream of said discharging device and lower than said discharging device.

2. A sheet processing apparatus according to claim 1, further comprising a joining device, which joins the sheet bundle folded by said two-fold device into said discharging device, wherein said two-fold device is disposed in a branch-off path, which branches off at an upstream position of said stapler from said conveying path, and wherein said joining device has a discharging path, which directs the two-fold sheet bundle discharged from said two-fold device to an upstream position of said discharging device.

3. A sheet processing apparatus according to claim 2, wherein said two-fold device has a pair of bundle folding rollers rotated in pressure contact with each other in a direction toward said discharging device in a pressure contact portion between said pair of bundle folding rollers, and a thrust member disposed opposite to said pair of bundle folding rollers and thrusting along a pressure contact line between said pair of bundle folding rollers, and said discharging path communicates with an exit of said pressure contact portion between said pair of bundle folding rollers.

4. A sheet processing apparatus according to claim 3, wherein at least one of said pair of bundle folding rollers contacts with the sheet bundle to convey the sheet bundle along said branch-off path.

5. A sheet processing apparatus according to claim 2, wherein an extension portion of said branch-off path beyond said pair of bundle folding rollers is bent along a housing structure of said sheet processing apparatus.

6. An image forming apparatus comprising:

an image forming device, which forms an image on a sheet; and a sheet processing apparatus according to any one of claims 1 to 5 for receiving and processing the sheet on which the image has been formed by said image forming device.

7. An image forming apparatus according to claim 6, wherein said sheet processing apparatus is contained and disposed within a plane view of said image forming device, and said sheet processing apparatus is disposed above said image forming device.

8. An image forming apparatus according to claim 6, wherein a sheet processing of said sheet processing apparatus is controlled in common by a microcomputer control device, which controls said image forming device to form the image on the sheet.

9. An image forming apparatus according to claim 6, wherein said sheet processing apparatus is contained and disposed within a plane view of said image forming device, and said sheet processing apparatus is disposed under said image forming device.

10. An image forming apparatus comprising:

an image forming device which forms an image on a sheet;

a reader portion, which reads an image on an original; and a sheet processing apparatus according to any one of claims 1 to 5 for receiving and processing the sheet on which the image has been formed by said image forming device, wherein said housing structure of said sheet processing apparatus includes said image forming device and said reader portion.

* * * * *